US011566419B2

(12) United States Patent
Durali et al.

(10) Patent No.: US 11,566,419 B2
(45) Date of Patent: Jan. 31, 2023

(54) CONTROLLING ACOUSTICS OF A PERFORMANCE SPACE

(71) Applicants: Mohammad Durali, Tehran (IR); Mohamad Ali soleimani, Tehran (IR); Farhad Fallah Shabani, Lahijan (IR); Alireza Habibollahi, Isfahan (IR); Ashkan Sohbatloo, Tehran (IR); Amir Mehdi Soufi Enayati, Tehran (IR)

(72) Inventors: Mohammad Durali, Tehran (IR); Mohamad Ali soleimani, Tehran (IR); Farhad Fallah Shabani, Lahijan (IR); Alireza Habibollahi, Isfahan (IR); Ashkan Sohbatloo, Tehran (IR); Amir Mehdi Soufi Enayati, Tehran (IR)

(73) Assignees: DURALI SYSTEM DESIGN & AUTOMATION CO., Tehran (IR); SHARIF UNIVERSITY OF TECHNOLOGY, Tehran (IR)

( * ) Notice: Subject to any disclaimer, the term of this patent is extended or adjusted under 35 U.S.C. 154(b) by 802 days.

(21) Appl. No.: 16/435,504

(22) Filed: Jun. 9, 2019

(65) Prior Publication Data

US 2019/0292774 A1 Sep. 26, 2019

Related U.S. Application Data

(60) Provisional application No. 62/683,660, filed on Jun. 12, 2018.

(51) Int. Cl.
*E04B 1/99* (2006.01)
*E04H 3/22* (2006.01)
(Continued)

(52) U.S. Cl.
CPC ..... *E04B 1/994* (2013.01); *E04B 1/34321* (2013.01); *E04B 1/8409* (2013.01); *E04H 3/22* (2013.01)

(58) Field of Classification Search
CPC ..... E04B 1/994; E04B 1/99; E04B 1/34321; E04B 1/34305; E04B 1/8409; E04B 1/84;
(Continued)

(56) References Cited

U.S. PATENT DOCUMENTS 1,675,102 A * 6/1928 Holland ..... G10K 11/20 181/287
1,825,465 A * 9/1931 MacDonald ..... E04B 1/994 181/30
(Continued)

FOREIGN PATENT DOCUMENTS

AT 413901 B * 4/2006 ..... G10K 11/172
CN 101086178 A * 12/2007
(Continued)

*Primary Examiner* — Edgardo San Martin
(74) *Attorney, Agent, or Firm* — Bajwa IP Law Firm; Haris Zaheer Bajwa

(57) ABSTRACT

A method for changing acoustics of a performance space may include mounting a plurality of panel assemblies to a ceiling or a portion of a ceiling of the performance space. Each panel assembly of the plurality of panel assemblies may include one or more acoustic panels. The exemplary method may further include changing a distance of the one or more acoustic panels of each panel assembly of the plurality of panel assemblies from the ceiling by coupling the one or more acoustic panels of each panel assembly of the plurality of panel assemblies with a first actuating mechanism, and actuating a linear vertical movement of the one or more acoustic panels of each panel assembly of the plurality of panel assemblies along a first axis perpendicular to the ceiling utilizing the first actuating mechanism.

18 Claims, 15 Drawing Sheets

(51) Int. Cl.
*E04B 1/84* (2006.01)
*E04B 1/343* (2006.01)
*E04H 3/30* (2006.01)

(58) Field of Classification Search
CPC ..... E04B 1/8236; E04B 1/343; E04B 2001/8423; E04B 2001/8433; E04B 2001/34394; E04B 9/20; E04B 9/18; E04H 3/22; E04H 3/24; E04H 3/30
See application file for complete search history.

(56) References Cited

U.S. PATENT DOCUMENTS 1,896,844 A * 2/1933 Hanson ..... E04B 1/994 181/30
1,975,604 A * 10/1934 Hanson ..... E04B 1/994 181/287
3,049,190 A * 8/1962 Coffman ..... E04B 1/994 49/40
3,221,835 A * 12/1965 Wenger ..... E04B 1/994 135/21
3,382,947 A * 5/1968 Biggs ..... E04B 1/994 181/30
3,409,099 A * 11/1968 Wenger ..... G10K 11/20 248/327
3,411,605 A * 11/1968 Coffman ..... E04B 1/994 181/30
3,447,628 A * 6/1969 Shiflet ..... E04B 1/994 318/265
3,469,354 A * 9/1969 Meetze, Jr. ..... G05D 3/14 52/6
4,823,908 A * 4/1989 Tanaka ..... H04R 1/345 381/387
6,431,312 B1 * 8/2002 D'Antonio ..... E04B 1/994 181/295
8,573,356 B1 * 11/2013 Perdue ..... G10K 11/20 181/295
8,615,970 B2 * 12/2013 Hoberman ..... E06B 9/24 49/128
9,322,165 B2 * 4/2016 Luhtala ..... E04B 1/84
9,708,811 B2 * 7/2017 Hsieh ..... G10K 11/16
9,932,736 B2 * 4/2018 Ryan ..... G10K 11/16
10,032,444 B2 * 7/2018 Jambrosic ..... G10K 11/172
10,119,269 B2 * 11/2018 Perdue ..... G10K 11/004
10,431,196 B2 * 10/2019 Naya ..... B32B 9/047
2010/0198426 A1 * 8/2010 Kondo ..... G10K 11/28 181/287
2014/0299407 A1 * 10/2014 Caimi ..... E04B 9/001 181/287
2017/0198474 A1 * 7/2017 Graves ..... E04B 1/994
2021/0404179 A1 * 12/2021 Gritcai ..... E04B 9/001

FOREIGN PATENT DOCUMENTS

CN 212129652 U * 12/2020 ..... E04C 1/395
CN 113323227 A * 8/2021
DE 202007006877 U1 * 10/2007 ..... E04B 1/994
FI 128271 B * 2/2020
JP 05143081 A * 6/1993
KR 20010069730 A * 7/2001
KR 20090088468 A * 8/2009
KR 20100035219 A * 4/2010
KR 102221460 B1 * 3/2021
WO WO-03035991 A2 * 5/2003 ..... E04B 9/00
WO WO-2013134340 A1 * 9/2013 ..... E04B 9/34
WO WO-2018162014 A1 * 9/2018 ..... E04B 1/84

* cited by examiner

CONTROLLING ACOUSTICS OF A PERFORMANCE SPACE

CROSS-REFERENCE TO RELATED APPLICATION

This application claims the benefit of priority from U.S. Provisional Patent Application Ser. No. 62/683,660, filed on Jun. 12, 2018, and entitled "ACOUSTIC ELECTROMECHANICAL ROBOT FOR AUDITORIUM ROOF," which is incorporated herein by reference in its entirety.

TECHNICAL FIELD

The present disclosure relates to acoustics, and particularly relates to controlling acoustical conditions of a performance space. More particularly, the present disclosure is related to a system and method for dynamically controlling acoustical conditions of a performance space.

BACKGROUND

In acoustic design of a performance space, such as a concert hall, a movie theater, a conference venue or a recording studio, different acoustic systems and products may be added to an interior of the performance space to modify sound absorbing/reflecting properties of the performance space. Such acoustic systems may include elements that may be developed for spatial configuration of the performance space such as reflector panels or variable absorption curtains. For example, trihedral prisms that may include one or more surfaces with different acoustic properties may be installed on a ceiling or walls of a performance space and sound absorbing/reflecting characteristics of the performance space may be changed by rotating the trihedral prisms such that a specific surface of the one or more surfaces of each trihedral prism may be exposed to the performance space.

Acoustical demands within the performance space or a portion of the performance space may change due to differences in performance types, number and seating configuration of audience members, and configuration of the performance stage. These changes in acoustical demands may be very dynamic and they may even occur during a single performance within the performance space. Therefore, there is a need for systems and methods that may allow for making dynamic changes in spatial configuration of a performance space. There is further a need for systems that may dynamically determine acoustical demands within a performance space and change spatial configuration of the performance space, accordingly.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to a method for changing acoustics of a performance space. The exemplary method may include mounting a plurality of panel assemblies to a ceiling or a portion of the ceiling of the performance space.

Each panel assembly of the plurality of panel assemblies may include one or more acoustic panels where the one or more acoustic panels may be coupled to a respective first actuating mechanism. The exemplary method may further include changing a distance of the one or more acoustic panels of each panel assembly of the plurality of panel assemblies from the ceiling by actuating a linear vertical movement of the one or more acoustic panels of each panel assembly of the plurality of panel assemblies along a first axis perpendicular to the ceiling utilizing the first actuating mechanism.

In an exemplary embodiment, the exemplary method for changing acoustics of a performance space may further include coupling each acoustic panel of the one or more acoustic panels with a respective second actuating mechanism and changing orientations of the one or more acoustic panels of each panel assembly by actuating a rotational movement of each acoustic panel of the one or more acoustic panels about a second axis perpendicular to the first axis utilizing the respective second actuating mechanism.

In an exemplary embodiment, the exemplary method for changing acoustics of a performance space may further include coupling each acoustic panel of the one or more acoustic panels with a respective third actuating mechanism, where changing orientations of the one or more acoustic panels of each panel assembly may further include actuating a rotational movement of each acoustic panel of the one or more acoustic panels about a third axis perpendicular to the second axis utilizing the respective third actuating mechanism.

In an exemplary embodiment, the exemplary method for changing acoustics of a performance space may further include changing sound absorbing/reflecting properties of each acoustic panel of the one or more acoustic panels of each panel assembly. Each exemplary acoustic panel may include a first perforated reflective surface, a second perforated reflective surface that may be placed immediately above the first perforated reflective surface and slidably movable relative to the first perforated reflective surface, and a sound absorbing layer that may be positioned immediately above the second perforated surface. In an exemplary embodiment, changing sound absorbing/reflecting properties of each acoustic panel of the one or more acoustic panels of each panel assembly may include sliding the second perforated reflective surface over and relative to the first perforated reflective surface.

In an exemplary embodiment, the second perforated reflective surface may be coupled to a fourth actuating mechanism and sliding the second perforated reflective surface over and relative to the first perforated reflective surface may include actuating a linear movement of the second perforated reflective surface parallel to a tangential plane to the first perforated reflective surface utilizing the fourth actuating mechanism.

In an exemplary embodiment, actuating the linear movement of the second perforated reflective surface parallel to the tangential plane to the first perforated reflective surface may include linearly moving the second perforated reflective surface parallel to the tangential plane to the first perforated reflective surface from a first position to a second position. Perforations of the first perforated reflective surface may be in alignment with corresponding perforations of the second perforated reflective surface in the first position exposing a portion of a surface of the sound absorbing layer to the performance space through the aligned perforations of the first perforated reflective surface and the second perforated reflective surface. The perforations of the first perforated reflective surface may be out of alignment with the corresponding perforations of the second perforated reflective surface in the second position.

In an exemplary embodiment, an exemplary method for changing acoustics of a performance space may further include determining a first desired orientation of each acoustic panel of the one or more acoustic panels with respect to the second axis and a second desired orientation of each acoustic panel of the one or more acoustic panels with respect to the third axis based at least in part on one of acoustic pressure changes in the performance space and occupancy of individuals in the performance space.

In an exemplary embodiment, actuating the rotational movement of each acoustic panel of the one or more acoustic panels about the second axis may include changing an orientation of each acoustic panel of the one or more acoustic panels about the second axis to the first desired orientation, and actuating the rotational movement of each acoustic panel of the one or more acoustic panels about the third axis may include changing the orientation of each acoustic panel of the one or more acoustic panels about the third axis to the second desired orientation.

In an exemplary embodiment, an exemplary method for changing acoustics of a performance space may further include determining a desired distance of the one or more acoustic panels of each panel assembly of the plurality of panel assemblies from the ceiling based at least in part on one of acoustic pressure changes in the performance space and occupancy of individuals in the performance space.

In an exemplary embodiment, actuating the linear vertical movement of the one or more acoustic panels of each panel assembly of the plurality of panel assemblies along the first axis may include vertically moving the one or more acoustic panels of each panel assembly of the plurality of panel assemblies to the desired distance.

In an exemplary embodiment, coupling the one or more acoustic panels of each panel assembly of the plurality of panel assemblies with the first actuating mechanism may include coupling the one or more acoustic panels with the first actuating mechanism. In an exemplary embodiment, the first actuating mechanism may include a telescopic column mounted to the ceiling from an upper end of the telescopic column and attached to the one or more acoustic panels from an opposing lower end of the telescopic column, and a first linear actuator coupled with the telescopic column. In an exemplary embodiment, actuating the linear vertical movement of the one or more acoustic panels of each panel assembly of the plurality of panel assemblies along the first axis may include vertically extending or retracting the telescopic column utilizing the first linear actuator along the first axis.

In an exemplary embodiment, an exemplary method for changing acoustics of a performance space may further include changing orientations of the one or more acoustic panels of each panel assembly by coupling each acoustic panel of the one or more acoustic panels with a respective second actuating mechanism. The second actuating mechanism may include an elongated bar coupled from a first end of the elongated bar with the opposing lower end of the telescopic column utilizing a revolute joint, and a second linear actuator mounted to the opposing lower end of the telescopic column at a first free-to-pivot mounting point above the revolute joint, the second linear actuator coupled to a second end of the elongated bar at a second free-to-pivot mounting point. The second end of the elongated bar may be away from the revolute joint. Coupling each acoustic panel with the respective second actuating mechanism may include attaching each acoustic panel from a side of each acoustic panel to the elongated bar. Changing orientations of the one or more acoustic panels of each panel assembly may further be carried out by actuating a rotational movement of each acoustic panel of the one or more acoustic panels about a second axis perpendicular to the first axis by actuating a rotational movement of the elongated bar about the revolute joint by extending or retracting the second linear actuator.

In an exemplary embodiment, each acoustic panel of the one or more acoustic panels may be coupled to a respective third actuating mechanism. The third actuating mechanism may include a third linear actuator mounted on the opposing second end of the elongated bar at a third free-to-pivot mounting point above the second free-to-pivot mounting point. The third linear actuator may be coupled with each acoustic panel at a fourth free-to-pivot mounting point located in a center of each acoustic panel. In an exemplary embodiment, changing orientations of the one or more acoustic panels of each panel assembly may further include actuating a rotational movement of each acoustic panel of the one or more acoustic panels about a third axis perpendicular to the second axis by extending or retracting the third linear actuator.

According to one or more exemplary embodiments, the present disclosure is directed to a system for changing acoustics of a performance space. The exemplary system may include a plurality of panel assemblies that may be mounted to a ceiling or a portion of the ceiling of a performance space. Each panel assembly of the plurality of panel assemblies may include one or more acoustic panels and a first actuating mechanism that may be coupled to the one or more acoustic panels. The first actuating mechanism may be configured to actuate a vertical linear movement of the one or more panel assemblies relative to the ceiling along a first axis. Each panel assembly of the plurality of panel assemblies may further include a second actuating mechanism that may be coupled to each acoustic panel of the one or more acoustic panels. The second actuating mechanism may be configured to actuate a rotational movement of each acoustic panel about a second axis perpendicular to the first axis. Each panel assembly of the plurality of panel assemblies may further include a third actuating mechanism that may be coupled to each acoustic panel of the one or more acoustic panels. The third actuating mechanism may be configured to actuate a rotational movement of each acoustic panel about a third axis perpendicular to the second axis. The exemplary system may further include a control unit that may be coupled to the plurality of panel assemblies and may be configured to control one of the first actuating mechanism, the second actuating mechanism, and the third actuating mechanism.

In an exemplary embodiment, the exemplary system may further include a sensor unit in data communication with the control unit. The sensor unit may include at least one acoustic sensor that may be configured to collect samples of acoustic pressure changes within the performance space, and at least one image capturing device that may be configured to capture images of the performance space.

In an exemplary embodiment, the control unit may include a processor, and a memory that may be configured to store executable instructions to cause the processor to: determine at least one of occupancy and movement of individuals within the performance space, and to determine a spatial configuration for the panel assemblies based at least in part on the collected samples of acoustic pressure changes within the performance space and the occupancy of individuals within the performance space, and the movement of individuals within the performance space.

In an exemplary embodiment, each acoustic panel of the one or more acoustic panels may include a first perforated reflective surface, a second perforated reflective surface that may be placed immediately above the first perforated reflective surface and slidably movable relative to the first perforated reflective surface, and a sound absorbing layer that may be positioned immediately above the second perforated surface.

In an exemplary embodiment, the exemplary system may further include a fourth actuating mechanism that may be coupled to the second perforated reflective surface of each acoustic panel of the one or more acoustic panels. The fourth actuating mechanism may be configured to actuate a linear movement of the second perforated reflective surface relative to the first perforated reflective surface from a first position to a second position.

In an exemplary embodiment, perforations of the first perforated reflective surface may be in alignment with corresponding perforations of the second perforated reflective surface in the first position exposing a portion of a surface of the sound absorbing layer to the performance space through the aligned perforations of the first perforated reflective surface and the second perforated reflective surface. The perforations of the first perforated reflective surface may be out of alignment with the corresponding perforations of the second perforated reflective surface in the second position.

In an exemplary embodiment, the exemplary system may further include a user-interface unit that may be connected in data communication with the control unit. The user-interface unit may be configured to receive a data input from a user. The data input may include a desired spatial configuration of the plurality of panel assemblies selected by the user from a set of predefined spatial configurations.

In an exemplary embodiment, the first actuating mechanism may include a telescopic column that may be mounted to the ceiling from an upper end of the telescopic column and attached to the one or more acoustic panels from an opposing lower end of the telescopic column, and a first linear actuator that may be coupled with the telescopic column configured to vertically extend or retract the telescopic column along the first axis.

In an exemplary embodiment, the second actuating mechanism may include an elongated bar coupled from a first end of the elongated bar with the opposing lower end of the telescopic column utilizing a revolute joint and a second linear actuator mounted to the opposing lower end of the telescopic column at a first free-to-pivot mounting point above the revolute joint, the second linear actuator coupled to a second end of the elongated bar at a second free-to-pivot mounting point, the second end of the elongated bar away from the revolute joint.

In an exemplary embodiment, the third actuating mechanism may include a third linear actuator mounted on the opposing second end of the elongated bar at a third free-to-pivot mounting point above the second free-to-pivot mounting point. The third linear actuator may be coupled with each acoustic panel at a fourth free-to-pivot mounting point located in a center of each acoustic panel.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
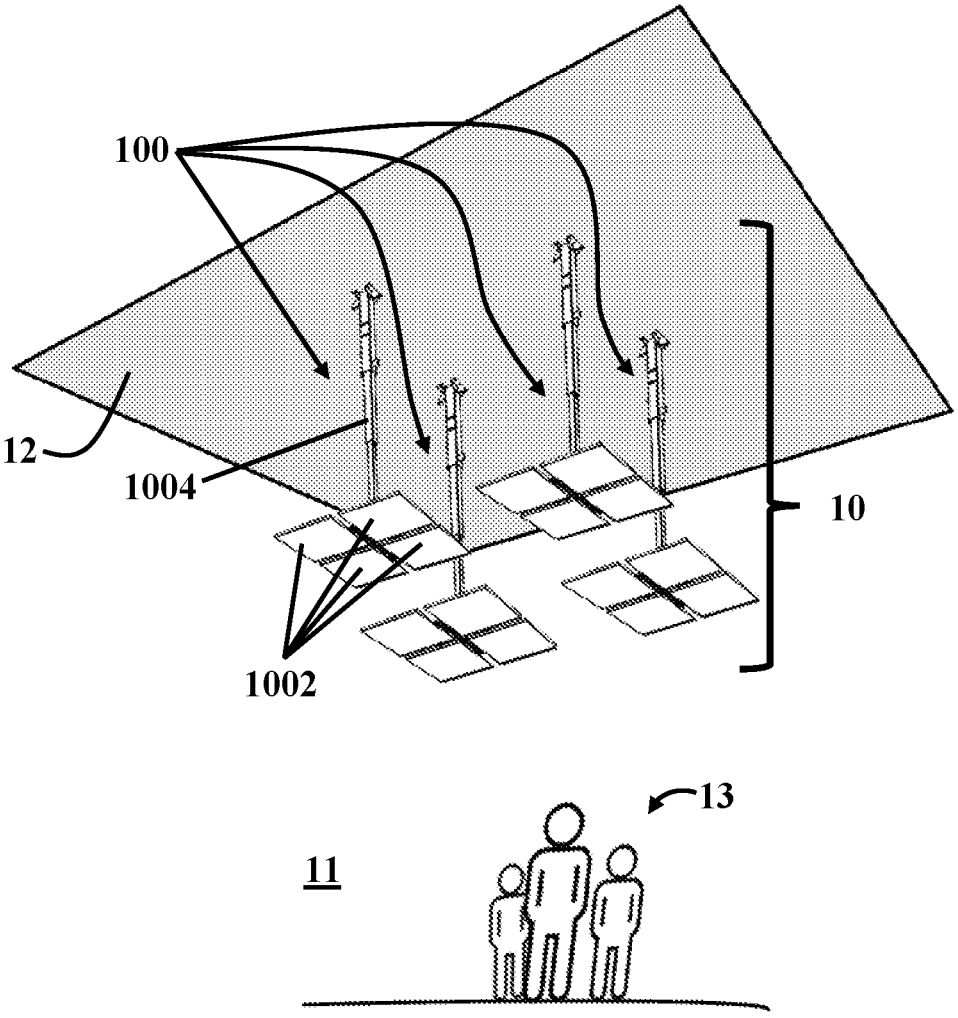
FIG. 1A illustrates an apparatus for dynamically controlling acoustics of a performance space, consistent with one or more exemplary embodiments of the present disclosure.

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to a system and method for controlling acoustics of a performance space that may be used as a concert hall, movie theatre, conference hall, recording studio, and a space for acoustic experiments. The exemplary system may include one or more panel assemblies that may be suspended from a ceiling of a performance space. Each of the exemplary panel assemblies may include one or more acoustic panels with adjustable sound reflecting and sound absorbing properties, as well as adjustable orientation and position with respect to each other and to the ceiling of the performance hall. In an exemplary system and method, sound reflecting and sound absorbing properties of the acoustic panels, as well as their orientation and position may be changed in response to changes in acoustical demands within the performance hall. As mentioned before, acoustical demands within the performance space or a portion of the performance space may be different due to differences in performance types, number and seating configuration of audience members, and configuration of a performance stage. The exemplary panel assemblies may allow for an exemplary system to be capable of changing a volume and a shape of a performance space. Accordingly, this spatial configurability may allow independent modification of various acoustic characteristics of the performance space, such as reverberation.

Exemplary panel assemblies may further include one or more robotic manipulators that may be coupled with one or more acoustic panels in order to suspend the one or more acoustic panels from the ceiling and manipulate the one or more acoustic panels to change their position and/or orientation relative to each other. An exemplary system may further include a control unit that may be functionally coupled with and control the one or more acoustic panel assemblies. An exemplary system may further include an ambient sensor unit that may be coupled with an exemplary control unit and may sense and transmit at least one of acoustic pressure changes in space and occupancy of individuals in a space. An exemplary control unit may process signals received from an exemplary ambient sensor unit and may determine acoustical demands of a performance hall based at least in part on received sensor signals. Exemplary control unit may then urge one or more robotic manipulators to change orientation and position of acoustic panels, as well as adjust or change their sound reflecting and sound absorbing properties, accordingly.

Each exemplary acoustic panel may include a first perforated reflective surface and a second perforated reflective surface that may be placed immediately above the first perforated reflective surface. The exemplary second perforated reflective surface may slide over and relative to the exemplary first perforated reflective surface and their respective perforations may move into alignment or out of alignment based on their relative position. Each exemplary acoustic panel may further include a sound absorbing layer positioned immediately above the second perforated reflective surface. Such configuration of the two perforated reflective surfaces and the absorbing layer may allow for changing sound reflecting and sound absorbing properties of each exemplary acoustic panel by sliding the second perforated reflective surface over and relative to the first perforated reflective surface and exposing the sound absorbing layer to the performance space with different amounts of exposure, as will be described in further detail below.

The exemplary system and method may be utilized in the design of a variable-acoustics performance space and may allow for dynamically changing the acoustical properties of the variable-acoustics performance space based on performance types, number and seating configuration of audience members, and configuration of the performance stage.

FIG. 1A illustrates an apparatus 10 for dynamically controlling acoustics of a performance space, consistent with one or more exemplary embodiments of the present disclosure. In an exemplary embodiment, in performance space 11, apparatus 10 and audience 13 are displayed. In an exemplary embodiment, apparatus 10 may include one or more panel assemblies 100 that may be suspended from a ceiling 12 of performance space 11. In an exemplary embodiment, panel assemblies 100 may be essentially identical to each other in construction and each panel assembly 100 may include one or more acoustic panels 1002 and a robotic manipulator 1004 that may be coupled to one or more acoustic panels 1002 and may manipulate one or more acoustic panels 1002 to change their orientation relative to each other and their position relative to ceiling 12. In an exemplary embodiment, acoustic panels 1002 may be essentially identical to each other in construction and may each possess adjustable sound reflecting and sound absorbing properties, as will be described. In an exemplary embodiment, robotic manipulator 1004 may further be configured to change sound reflecting and sound absorbing properties of corresponding acoustic panels 1002. In exemplary embodiments, adjustable height, orientation, and sound reflecting/absorbing properties of panel assemblies 100 may allow for apparatus 10 to be capable of changing sound reflecting/absorbing properties, shape, and height of the performance space or a portion of the performance space in response to changes in acoustical demands within the performance space. Acoustical demands within the performance space or a portion of the performance space may change due to differences in performance types, number and seating configuration of audience members, and configuration of the performance stage.

Figure 1B:
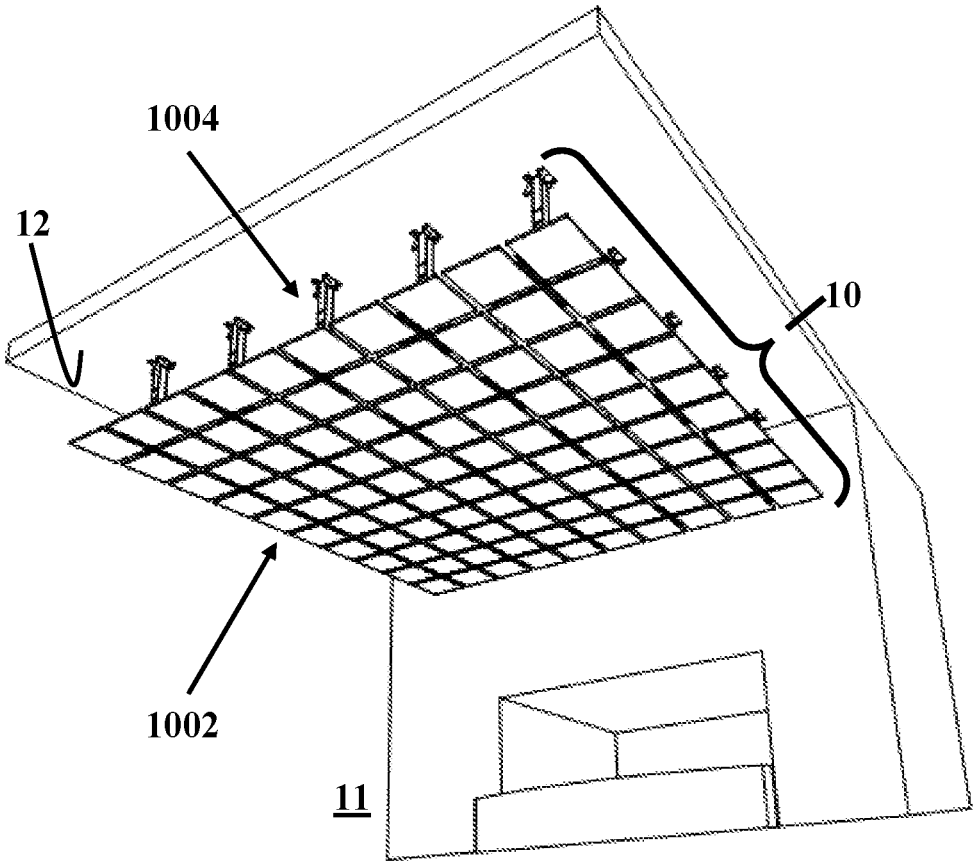
FIG. 1B illustrates a perspective view of an apparatus mounted to a ceiling of a performance space with all panel assemblies in a retracted position, consistent with one or more exemplary embodiments of the present disclosure.
Figure 1C:
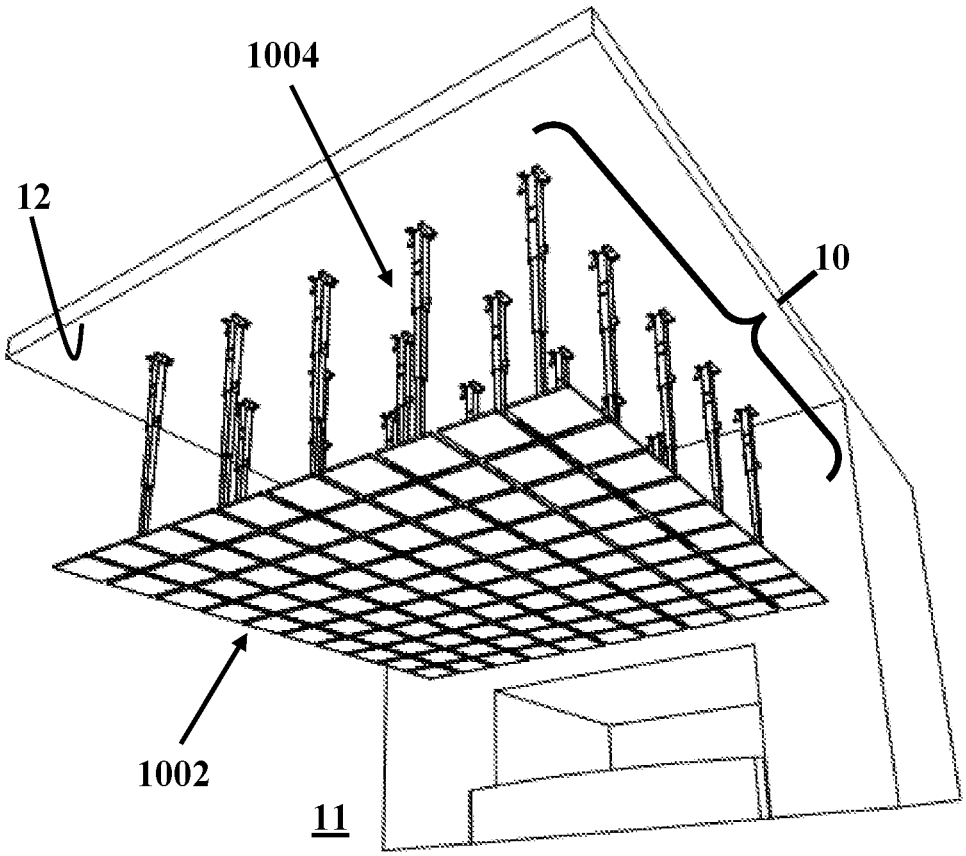
FIG. 1C illustrates a perspective view of an apparatus mounted to a ceiling of a performance space with all panel assemblies in an extended position, consistent with one or more exemplary embodiments of the present disclosure.
Figure 1D:
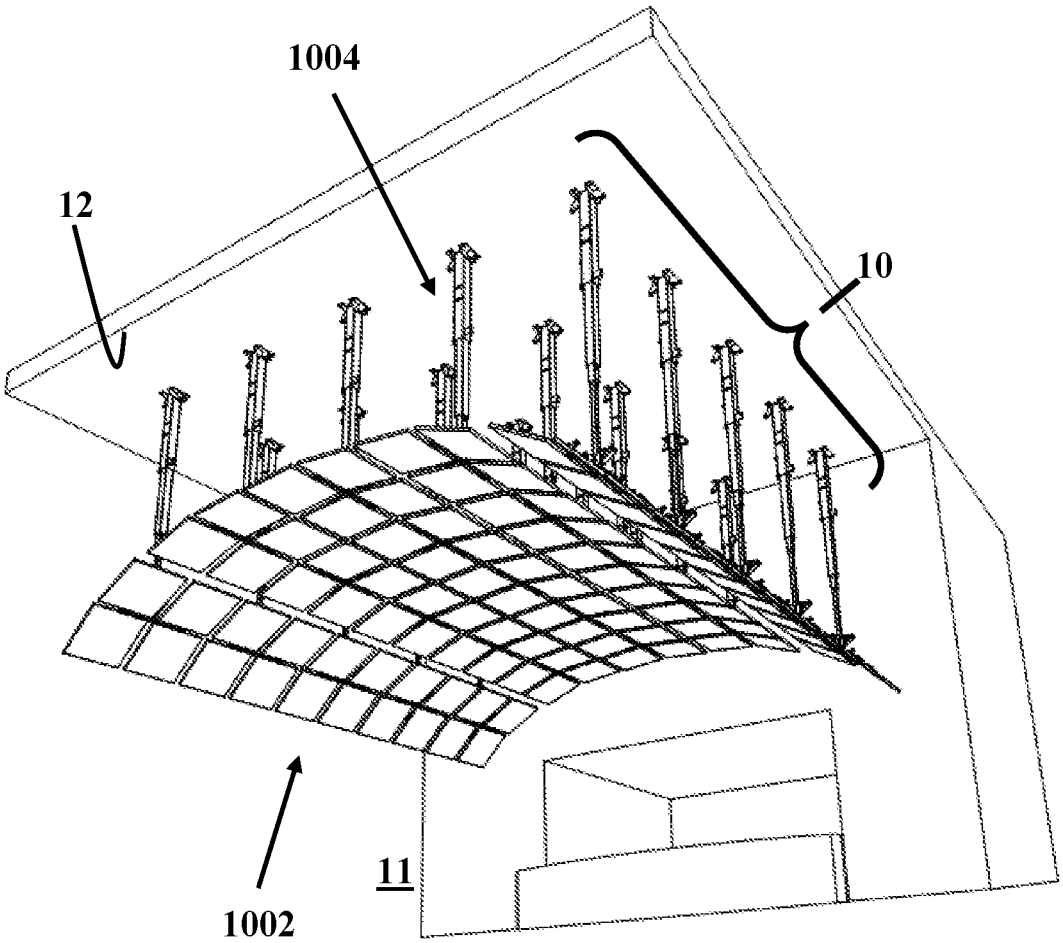
FIG. 1D illustrates a perspective view of an apparatus mounted to a ceiling of a performance space with panel assemblies forming a specific shape over the performance space, consistent with one or more exemplary embodiments of the present disclosure.

FIG. 1B illustrates a perspective view of apparatus 10 mounted to ceiling 12 of a performance space 11 with all panel assemblies 100 in a retracted position, consistent with one or more exemplary embodiments of the present disclosure. FIG. 1C illustrates a perspective view of apparatus 10 mounted to ceiling 12 of performance space 11 with all panel assemblies 100 in an extended position, consistent with one or more exemplary embodiments of the present disclosure. FIG. 1D illustrates a perspective view of apparatus 10 mounted to ceiling 12 of a performance space 11 with panel assemblies 100 forming a specific shape over the performance space, consistent with one or more exemplary embodiments of the present disclosure. In an exemplary embodiment, apparatus 10 may include one or more panel assemblies similar to each respective panel assembly of panel assemblies 100 that may be suspended from ceiling 12 to either cover the entire ceiling 12 or a portion of ceiling 12. In an exemplary embodiment, robotic manipulators 1004 of each panel assembly 100 may actuate a linear vertical movement of acoustic panels 1002 from a fully retracted position as depicted in FIG. 1B to a fully extended position as depicted in FIG. 1C. In an exemplary embodiment, robotic manipulators 1004 of panel assemblies 100 may actuate acoustic panels 1002 to change their orientation relative to each other so as to change a shape of the ceiling or a portion of the ceiling of the performance space to a desired shape to create a desired acoustical condition within the performance space. For example, as depicted in FIG. 1D, robotic manipulators 1004 may change orientations and positions of acoustic panels 1002 to create a curved ceiling over the performance space.

Figure 2A:
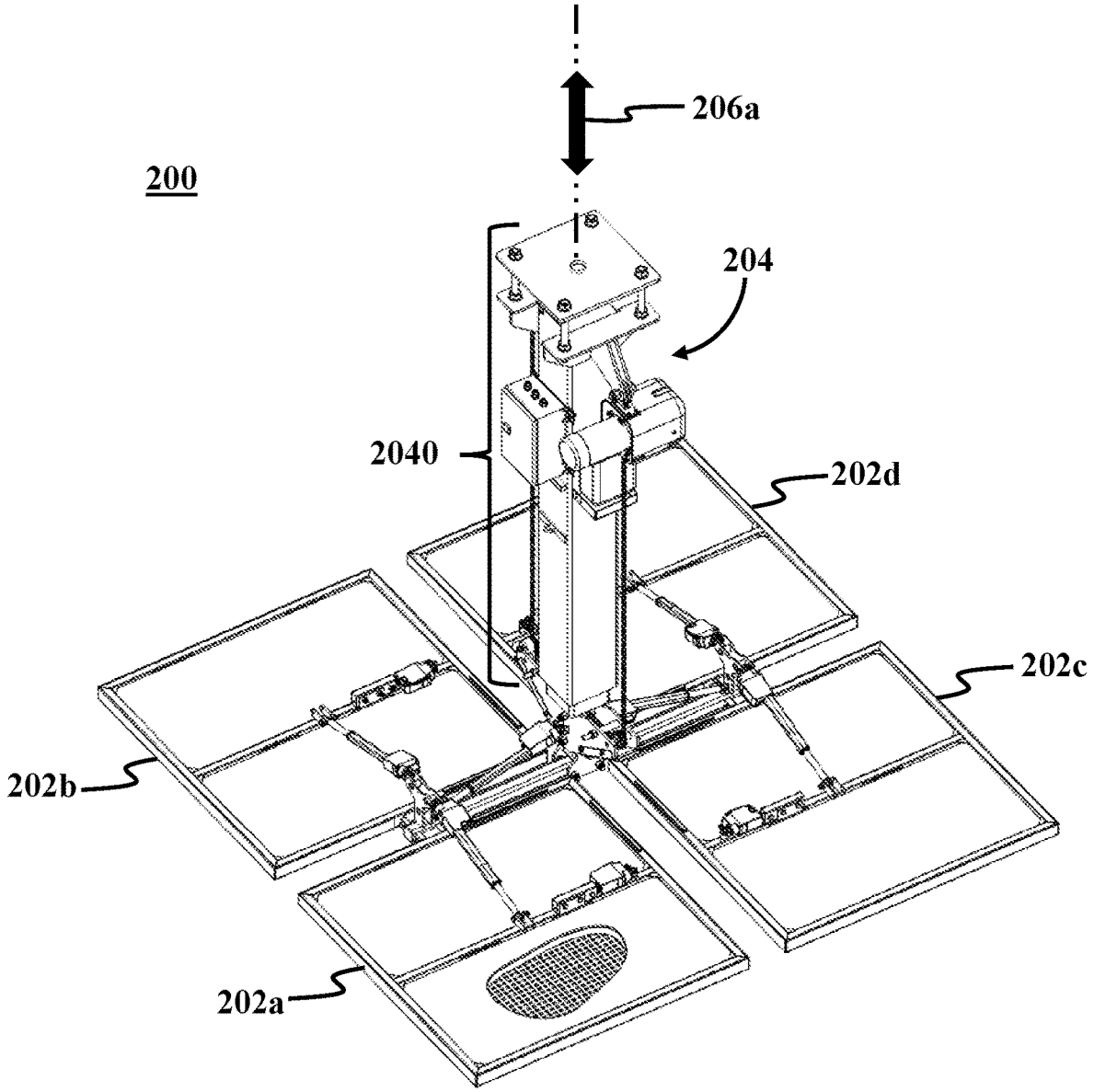
FIG. 2A illustrates a perspective view of a panel assembly, consistent with one or more exemplary embodiments of the present disclosure.
Figure 2B:
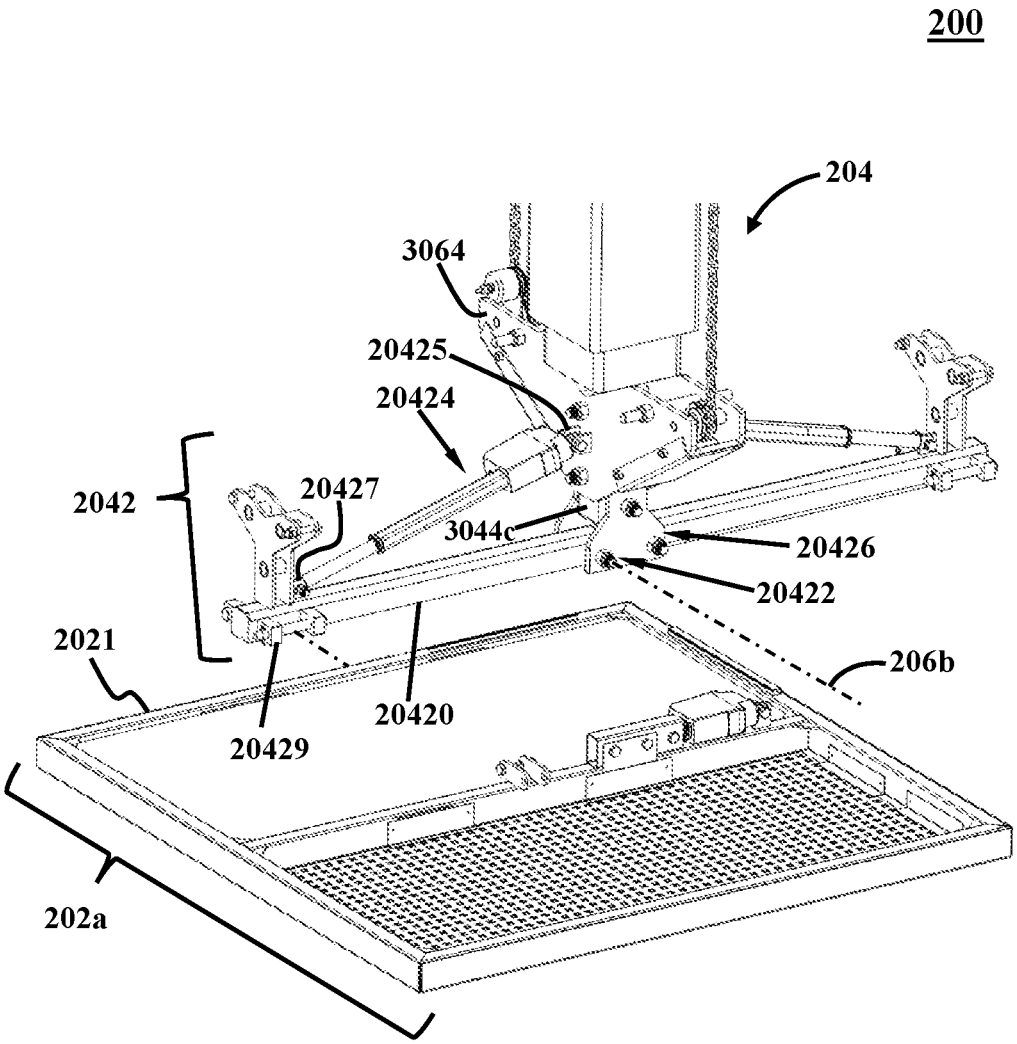
FIG. 2B illustrates an exploded perspective view of an acoustic panel coupled with a robotic manipulator of a panel assembly, consistent with one or more exemplary embodiments of the present disclosure.

FIG. 2A illustrates a perspective view of a panel assembly 200, consistent with one or more exemplary embodiments of the present disclosure. FIG. 2B illustrates an exploded perspective view of an acoustic panel 202*a* coupled with a robotic manipulator 204 of panel assembly 200, consistent with one or more exemplary embodiment of the present disclosure. In an exemplary embodiment, panel assembly 200 may be similar to each respective panel assembly of panel assemblies 100.

In an exemplary embodiment, panel assembly 200 may include one or more acoustic panels (202*a*, 202*b*, 202*c*, 202*d*) similar to each respective acoustic panel of acoustic panels 1002 that may be coupled with robotic manipulator 204 that may be similar to each respective robotic manipulator of robotic manipulators 1004. In an exemplary embodiment, robotic manipulator 204 may manipulate acoustic panels (202*a*, 202*b*, 202*c*, 202*d*) to change their orientation relative to each other and their position, as well as their sound reflecting/absorbing properties.

In an exemplary embodiment, robotic manipulator 204 may include a first linear actuating mechanism 2040 that may be mounted to a ceiling of a performance space similar to ceiling 12 and may actuate a linear movement of acoustic panels (202*a*, 202*b*, 202*c*, 202*d*) along a vertical axis 206*a* relative to the ceiling of the performance space from a fully retracted position near the ceiling, for example, similar to acoustic panels 1002 of FIG. 1B, or to a fully extended position, similar to acoustic panels 1002 of FIG. 1C. In an exemplary embodiment, each panel assembly of one or more panel assemblies 1002, such as panel assembly 200 may be retracted or extended relative to the ceiling of the performance space independent from other panel assemblies. In exemplary embodiments, this independent manipulation of panel assemblies 1002 may allow for local deformation of a ceiling of a performance hall in order to change, alter, and adjust acoustic properties of the ceiling or a portion of the ceiling as needed.

Figure 3A:
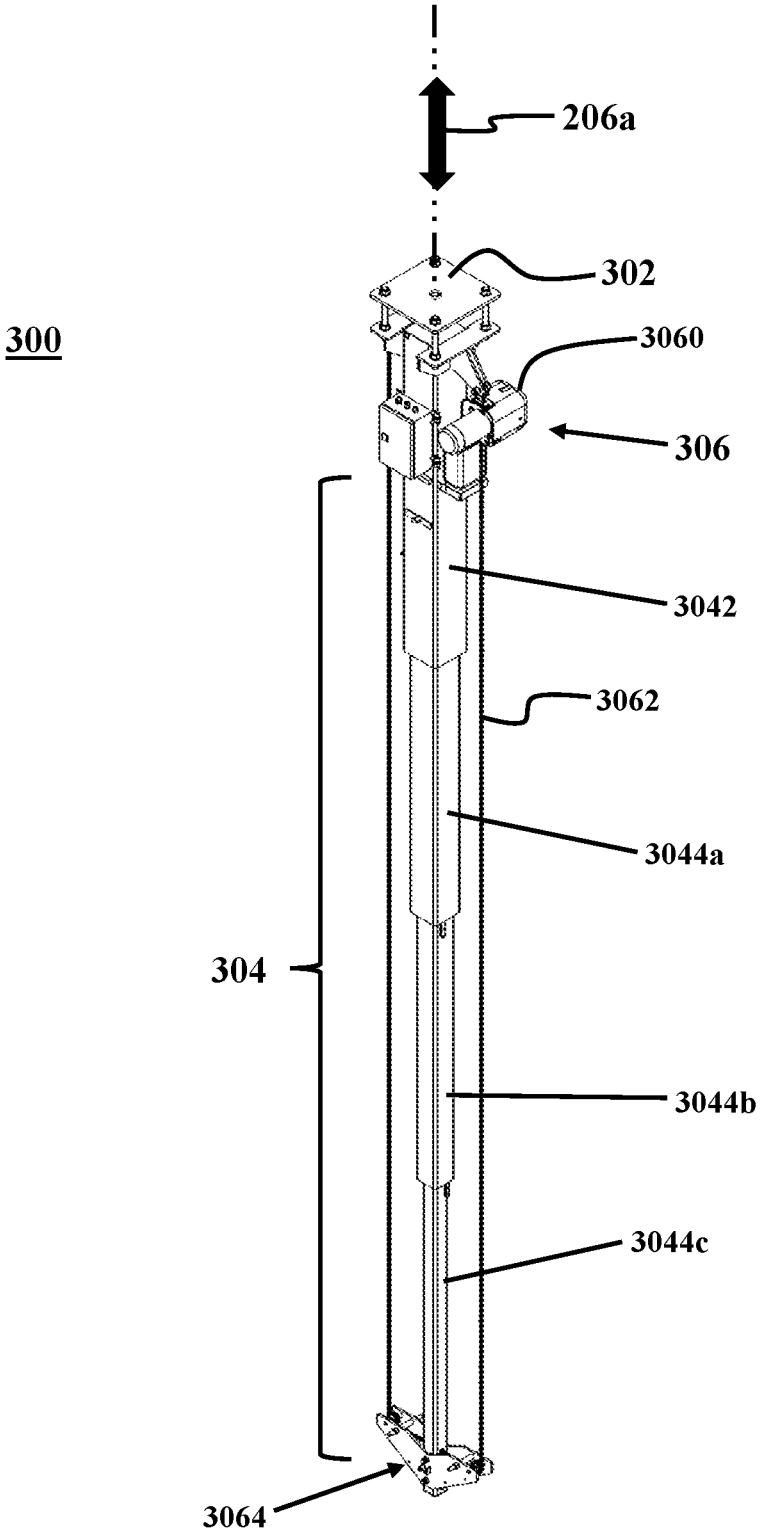
FIG. 3A illustrates a perspective view of a first linear actuating mechanism, consistent with one or more exemplary embodiments of the present disclosure.

FIG. 3A illustrates a perspective view of a first linear actuating mechanism 300, consistent with one or more exemplary embodiments of the present disclosure. In an exemplary embodiment, first linear actuating mechanism 300 may be similar to first linear actuating mechanism 2040 and may include an attachment member such as a flange 302 that may be utilized for mounting first linear actuating mechanism 300 to an exemplary ceiling of an exemplary performance space by, for example, bolting first linear actuating mechanism 300 to the ceiling. In an exemplary embodiment, first linear actuating mechanism 300 may include a telescopic column 304 that may be coupled with a linear actuator 306.

In an exemplary embodiment, telescopic column 304 may include a fixed tube section 3042 that may be attached to flange 302 and one or more intermediate tube sections (intermediate tube sections 3044*a*, 3044*b*), and a last tube section 3044*c* that may telescopically move within each other. In an exemplary embodiment, there may be additional intermediate tube sections providing similar functionality as the illustrated intermediate tube sections 3044*a*, 3044*b*. In an exemplary embodiment, fixed tube section 3042, intermediate tube sections 3044*a*, 3044*b*, and last tube section 3044*c* may be either round, square, or rectangular tube sections. A length of telescopic column 304 may be increased or in other words telescopic column 304 may be extended by sliding or moving intermediate tube sections 3044*a*, 3044*b* and last tube section 3044*c* telescopically downwards along axis 206*a*. Alternatively, a length of telescopic column 304 may be decreased or in other words telescopic column 304 may be retracted by sliding or moving intermediate tube sections 3044*a*, 3044*b* and last tube section 3044*c* telescopically upwards along axis 206*a*. In an exemplary embodiment, extension and retraction related movements of telescopic column 304 may be actuated in different possible ways, such as by utilizing electric actuators or hydraulic actuators. In case of performance spaces with strict safety regulations that do not allow hydraulic systems to be installed in a ceiling of the performance space, electric actuators may be utilized for actuating the extension or retraction of telescopic column 304. However, in the absence of such regulations, hydraulically actuated telescopic columns may be used as well.

In an exemplary embodiment, linear actuator 306 may include a hoist 3060 and a chain 3062, where chain 3062 may be coupled with last tube section 3044*c*. In an exemplary embodiment, hoist 3060 may be an electric hoist. Chain 3062 may be wrapped around a drum of hoist 3060. In an exemplary embodiment, hoist 3060 may pull telescopic column 304 up into a retracted position by pulling last tube section 3044*c* upward and hoist 3060 may allow telescopic column 304 to extend downwards due to force of gravity by releasing chain 3062 and allowing intermediate tube sections 3044*a*, 3044*b* and last tube section 3044*c* to slide downwards due to force of gravity to an extended position. In an exemplary embodiment, chain 3062 may be symmetrically looped around telescopic column 304 such that when hoist 3060 wraps chain 3062 around its drum, an upwards force may be exerted on last tube section 3044*c* in a substantially vertical direction along axis 206*a*. In an exemplary embodiment, symmetrically looping chain 3062 around telescopic column 304 may be accomplished by a coupling mechanism 3064.

Figure 3B:
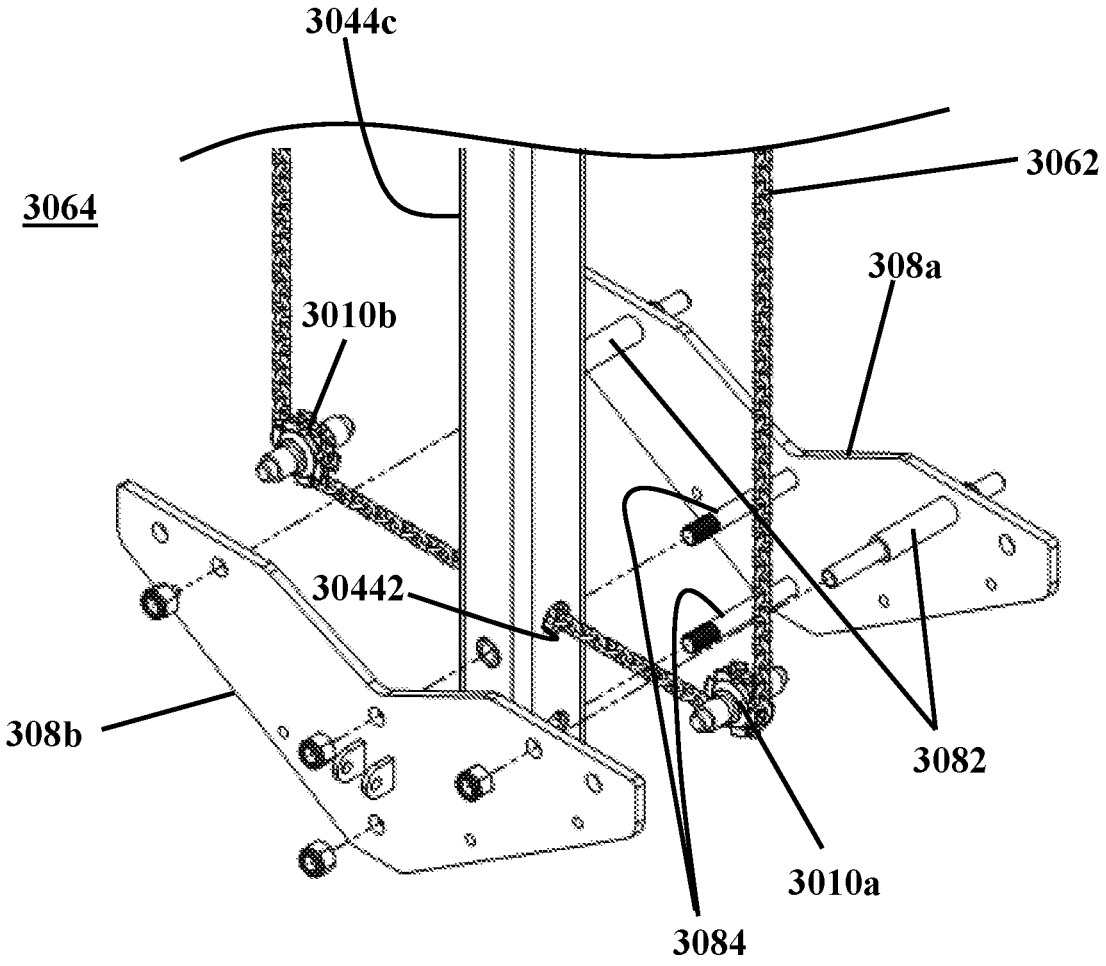
FIG. 3B illustrates an exploded view of a coupling mechanism for coupling a chain to a last tube section, consistent with one or more exemplary embodiments of the present disclosure.

FIG. 3B illustrates an exploded view of coupling mechanism 3064 for coupling chain 3062 to last tube section 3044*c*, consistent with one or more exemplary embodiment of the present disclosure. In an exemplary embodiment, coupling mechanism 3064 may include two plates 308*a-b* positioned at either sides of last tube section 3044*c* and connected to each other by fasteners 3082 and connected to last tube section 3044*c* by fasteners 3084. In an exemplary embodiments, fasteners 3082 and fasteners 3084 may include bolts and nuts. In an exemplary embodiment, coupling mechanism 3064 may further include two sprockets 3010*a-b* mounted between plates 308*a-b*. In an exemplary embodiment, chain 3062 may mesh with sprockets 3010*a-b*.

In an exemplary embodiment, last tube section 3044*c* may further include a hole 30442 through which chain 3062 may pass. Hole 30442 may be aligned with two sprockets 308*a-b* such that chain 3062 may rotate around sprockets 308*a-b* and through hole 30442. In an exemplary embodiment, as chain 3062 wraps around the drum of hoist 3060, it may pull up coupling mechanism 3064 and coupling mechanism 3064 may in turn pull up last tube section 3044*c*.

Figure 2C:
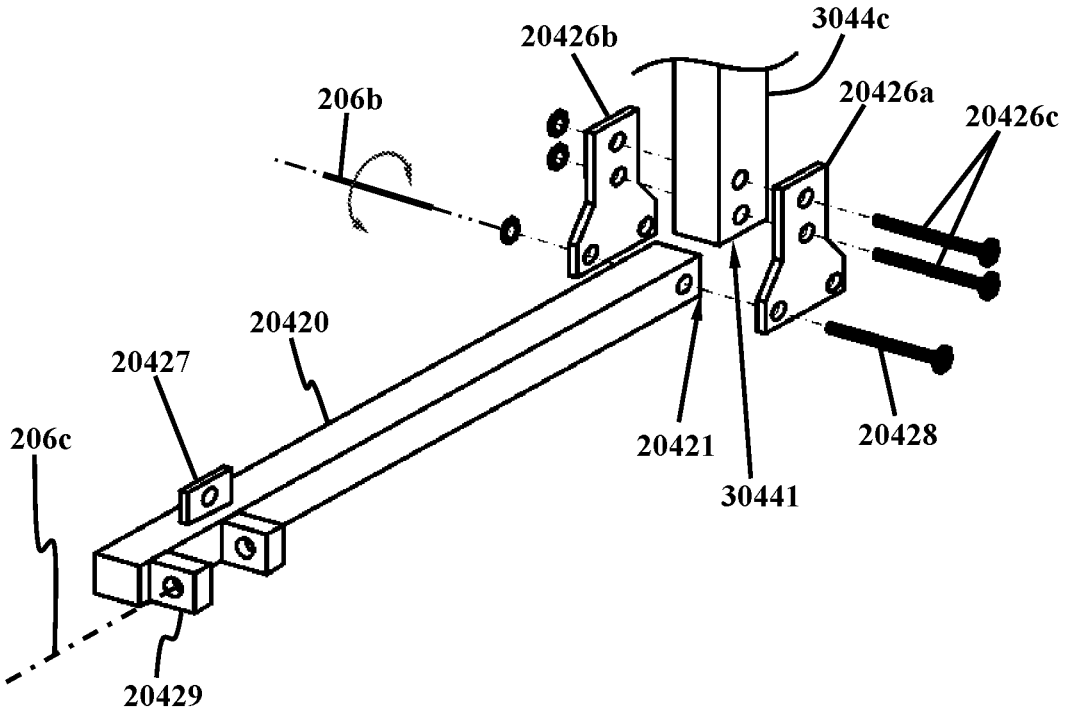
FIG. 2C illustrates an exploded view of an elongated bar coupled to a last tube section, consistent with one or more exemplary embodiments of the present disclosure.
Figure 2D:
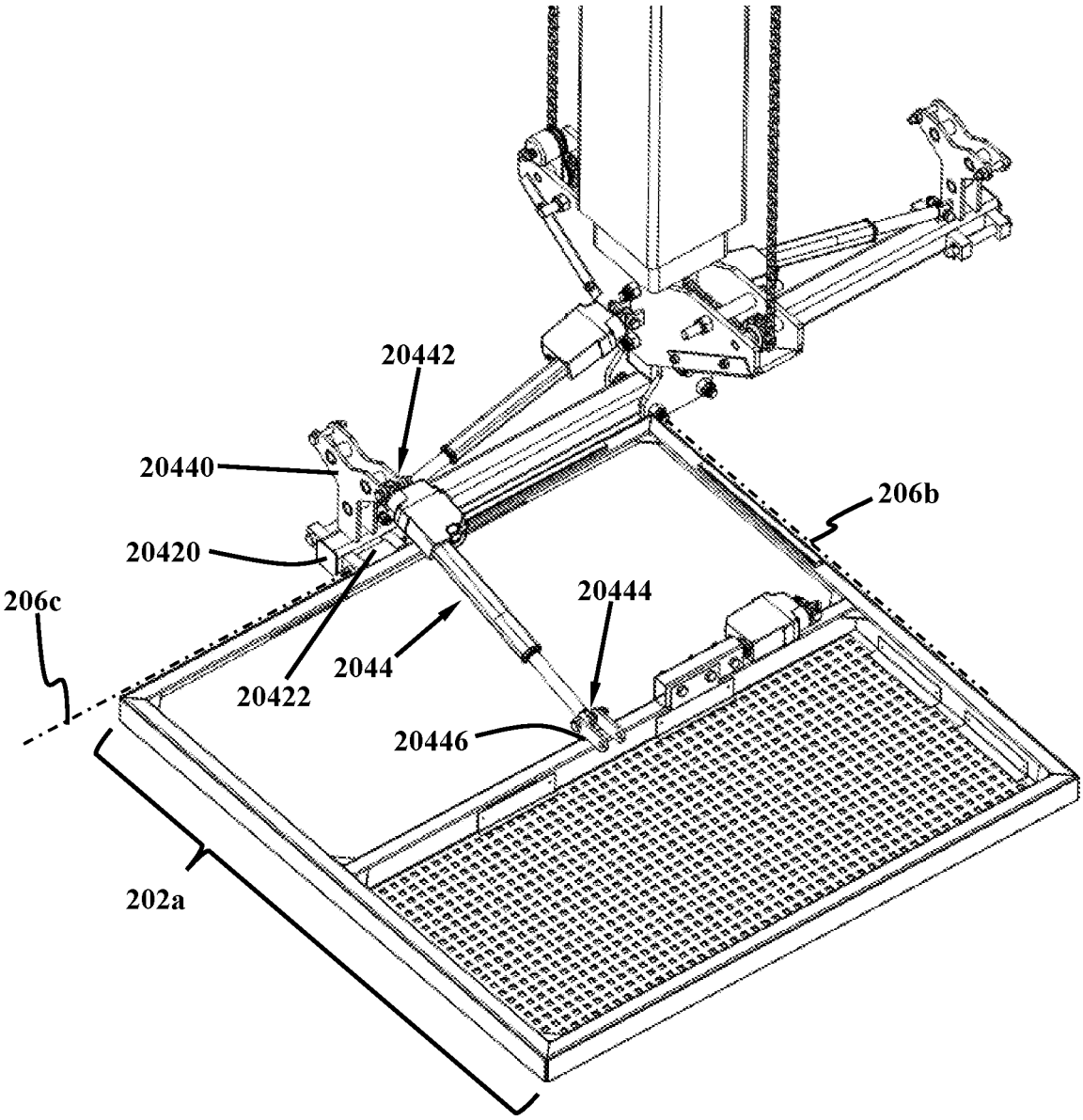
FIG. 2D illustrates a perspective view of an acoustic panel coupled with a robotic manipulator of a panel assembly, consistent with one or more exemplary embodiments of the present disclosure.

FIG. 2C illustrates an exploded view of an elongated bar 20420 coupled to last tube section 3044*c*, consistent with one or more exemplary embodiments of the present disclosure. FIG. 2D illustrates a perspective view of acoustic panel 202*a* coupled with robotic manipulator 204 of panel assembly 200, consistent with one or more exemplary embodiment of the present disclosure.

Referring to FIGS. 2B and 2C, in an exemplary embodiment, robotic manipulator 204 may further include a second actuating mechanism 2042 that may actuate a rotational movement of acoustic panel 202*a* about an axis 206*b* that may be perpendicular to axis 206*a*. In an exemplary embodiment, actuating mechanism 2042 may include an elongated bar 20420 that may be connected from a first end 20421 to a distal end 30441 of last tube section 3044*c* by a revolute joint 20422. In an exemplary embodiment, revolute joint 20422 may allow for elongated bar 20420 to pivot about axis 206*b*. In an exemplary embodiment, actuating mechanism 2042 may further include a second linear actuator 20424 that may be hinged to coupling mechanism 3064 from one end by hinge joint 20425 and to elongated bar 20420 from an opposing end by hinge joint 20427. In an exemplary embodiment this double-hinge connection utilizing hinge joints 20425 and 20427 may allow for second linear actuator 20424 to force elongated bar 20420 to pivot abut axis 206*b*. In an exemplary embodiment, acoustic panel 202*a* may be connected to elongated bar 20420 from a first edge 2021 by a revolute joint 20429. In an exemplary embodiment, first edge 2021 may be parallel with elongated bar 20420 and pivoting movement of elongated bar 20420 actuated by second actuator 20424 may urge a rotational movement of acoustic panel 202*a* about axis 206*b*.

In an exemplary embodiment, revolute joint 20422 may include a first fork 20426 and a mounting bolt 20428. In an exemplary embodiment, first fork 20426 may include two plates 20426*a-b* that may be bolted at either sides of distal end 30441 of last tube section 3044*c* by bolts 20426*c*.

Referring to FIGS. 2B and 2D, in an exemplary embodiment, robotic manipulator 204 may further include a third actuating mechanism 2044 that may actuate a rotational movement of acoustic panel 202*a* about an axis 206*c* that may be perpendicular to axis 206*b*. In an exemplary embodiment, axis 206 may be a longitudinal axis of revolute joint 20429 about which panel 202*a* may pivot. In an exemplary embodiment, an angle between axis 206*c* and axis 206*a* may change as elongated bar 20420 pivots about axis 206*b*, in other words, axis 206*c* may always remain parallel with elongated bar 20420.

In an exemplary embodiment, third actuating mechanism 2044 may be mounted on elongated bar 20420 utilizing a second fork 20440. In an exemplary embodiment, second fork 20440 may be attached on elongated bar 20420 above revolute joint 20422 and third actuating mechanism 2044 may be mounted on second fork 20440 at a pivot point 20442 from a first end and at a pivot point 20444 on a center point 20446 of acoustic panel 202*a* from a second end. In an exemplary embodiment, linear movement actuated by third actuating mechanism 2044 may urge acoustic panel 202*a* to pivot about revolute joint 20422 around axis 206*c*.

Figure 4A:
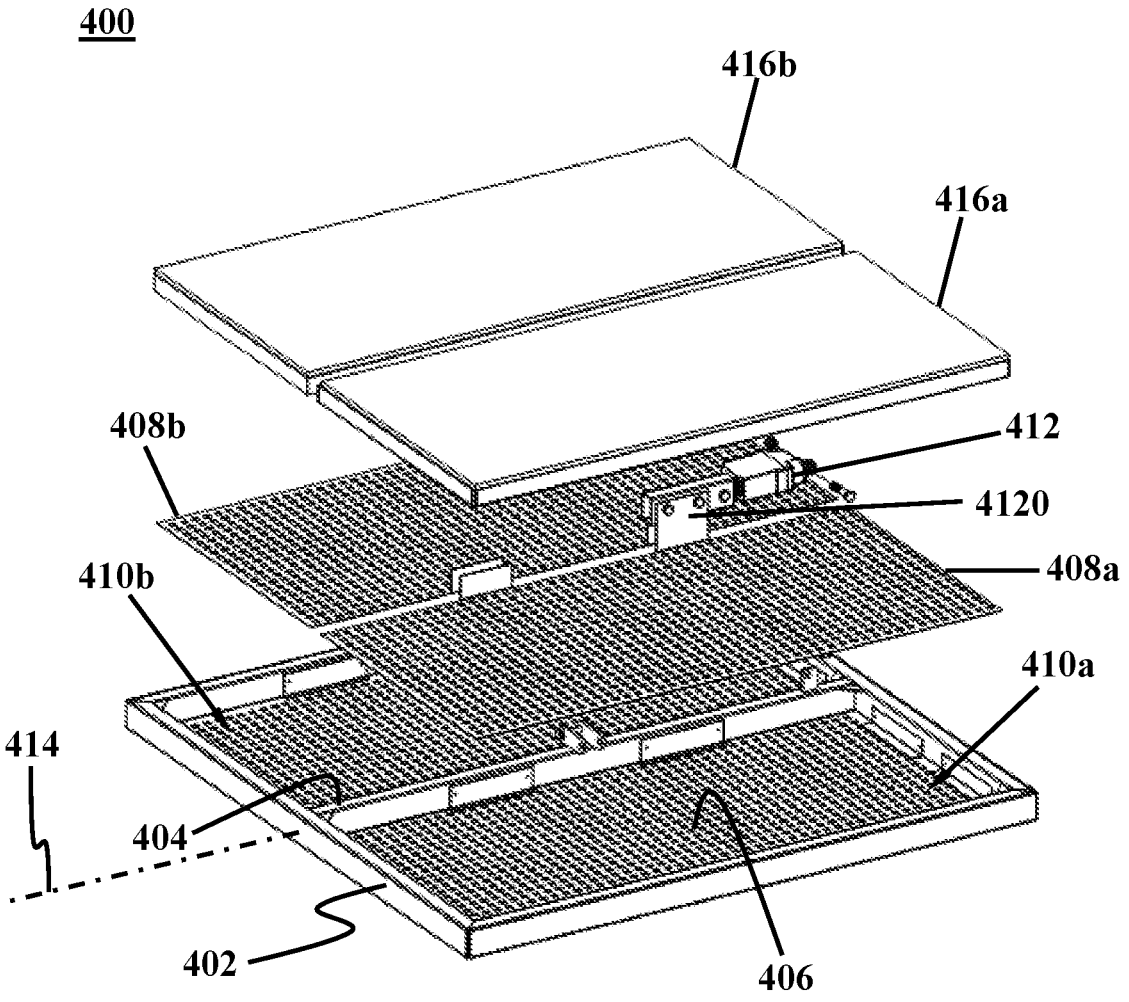
FIG. 4A illustrates an exploded view of an acoustic panel, consistent with one or more exemplary embodiments of the present disclosure.
Figure 4B:
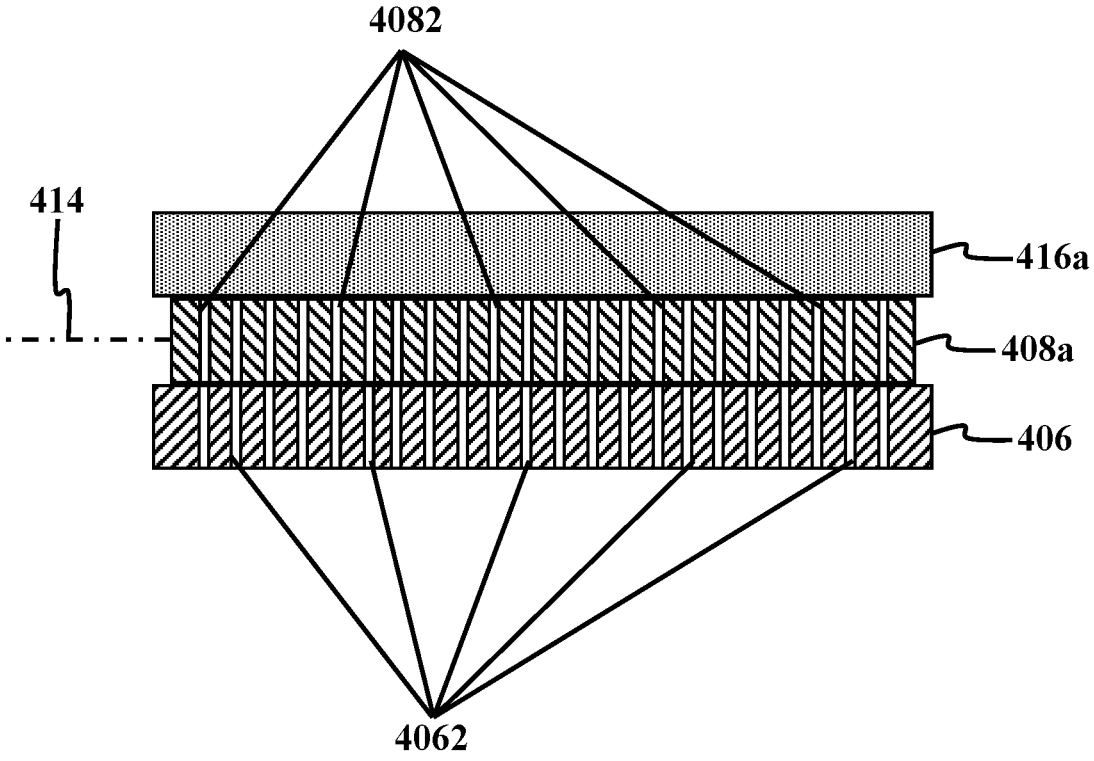
FIG. 4B illustrates a schematic sectional side-view of an acoustic panel in a first position, consistent with one or more exemplary embodiments of the present disclosure.
Figure 4C:
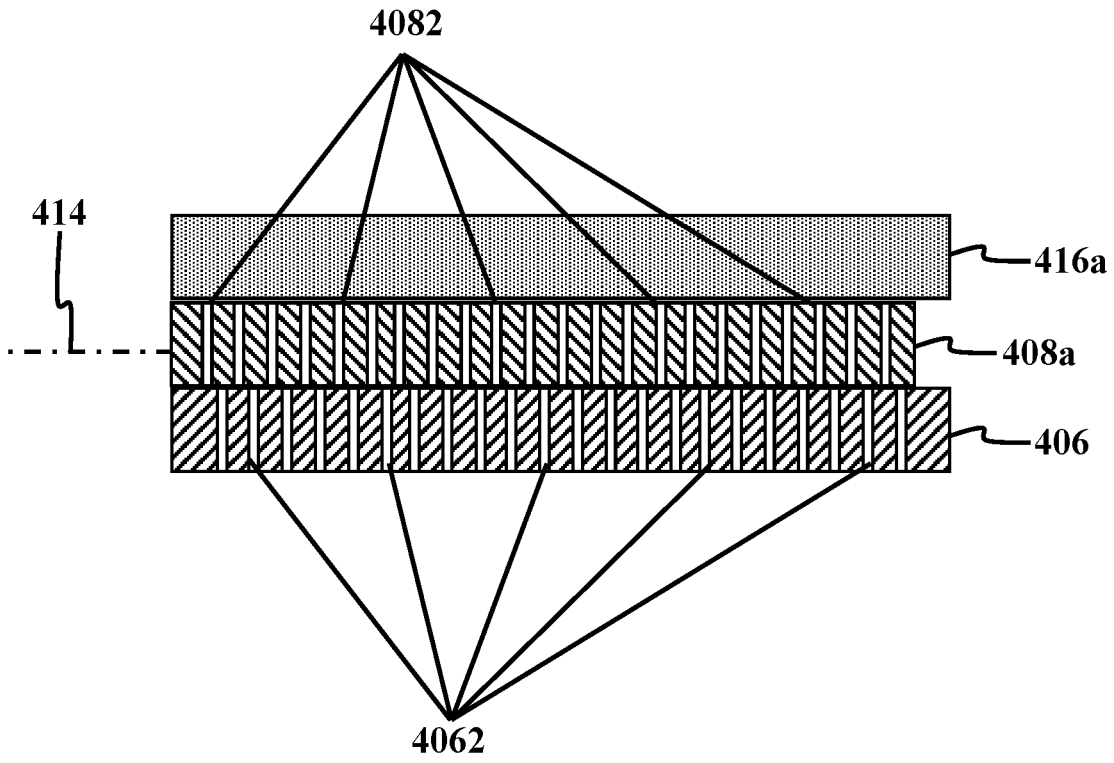
FIG. 4C illustrates a schematic sectional side-view of an acoustic panel in a second position, consistent with one or more exemplary embodiments of the present disclosure.

FIG. 4A illustrates an exploded view of an acoustic panel 400, consistent with one or more exemplary embodiments of the present disclosure. FIG. 4B illustrates a schematic sectional side-view of acoustic panel 400 in a first position, consistent with one or more exemplary embodiments of the present disclosure. FIG. 4C illustrates a schematic sectional side-view of acoustic panel 400 in a second position, consistent with one or more exemplary embodiments of the present disclosure. In an exemplary embodiment, acoustic panel 400 may be similar to acoustic panels 206*a*, 206*b*, 206*c*, and 206*d*.

In an exemplary embodiment, acoustic panel 400 may include a frame 402 that may be divided in the middle by a straight frame member 404. In an exemplary embodiment, acoustic panel 400 may further include a first perforated reflective layer 406 attached immediately below frame 402 covering an entire lower surface of acoustic panel 400. In an exemplary embodiment, acoustic panel 400 may further include two identical perforated reflective layers 408*a*, 408*b*, each mounted within frame 402 in a respective divided half 410*a*, 410*b* of frame 400 immediately above first perforated reflective layer 406. In an exemplary embodiment, perforated reflective layers 408*a*, 408*b* may be placed immediately above first perforated reflective layer 406 and may be configured to linearly slide over first perforated reflective layer 406 in a direction perpendicular to a surface normal of first perforated reflective layer 406.

In an exemplary embodiment, acoustic panel 402 may further include a linear actuator 412 that may be coupled to perforated reflective layers 408*a*, 408*b* utilizing connecting plates 4120. In an exemplary embodiment, linear actuator 412 may be configured to actuate a linear sliding motion of perforated reflective layers 408*a*, 408*b* over first perforated reflective surface 406. In an exemplary embodiment, linear actuator 412 may be mounted on straight frame member 404 and may be configured to drive a translational movement of perforated reflective layers 408*a*, 408*b* relative to straight frame member 404 and first perforated reflective layer 406 along translational axis 414. In an exemplary embodiment, linear actuator 412 may be configured to drive a translational movement of perforated reflective layers 408*a*, 408*b* along translational axis 414 from a first position where perforation of perforated reflective layers 408*a*, 408*b* may be in alignment with perforations of first perforated reflective layer 406 to a second position where perforation of perforated reflective layers 408*a*, 408*b* may be out of alignment with perforations of first perforated reflective layer 406.

In an exemplary embodiment, acoustic panel 400 may further include two identical sound absorbing layers 416*a*, 416*b* that may be positioned immediately above respective perforated reflective layers 408*a*, 408*b*. In an exemplary embodiment, in the first position of perforated reflective layers 408*a*, 408*b* on first perforated reflective layer 406, a portion of sound absorbing layers 416*a* and 416*b* may be exposed to the performance space. In an exemplary embodiment, in the second position of perforated reflective surfaces 408*a*, 408*b* on first perforated reflective layer 406, sound absorbing layers 416*a*, 416*b* may not be exposed to the performance space and an entire lower surface of acoustic panel 400 may be uniformly sound reflective. For example, as illustrated in FIG. 4B, in the first position, perforations 4082 of perforated reflective layer 408*a* may be in alignment with perforations 4062 of first perforated reflective layer 406, in other words, perforations 4082 and perforations 4062 form continuous holes through which sound absorbing layer 416*a* may be exposed to the performance space. For example, as illustrated in FIG. 4B, in the first position, perforations 4082 of perforated reflective layer 408*a* are in alignment with perforations 4062 of first perforated reflective layer 406 and sound absorbing layer 416*a* may be exposed to the performance space.

In exemplary embodiments, such configuration of first perforated reflective layer 406, perforated reflective layers 408*a*, 408*b*, and sound absorbing layers 416*a*, 416*b* may allow for adjusting sound absorbing/reflecting properties of acoustic panel utilizing linear actuator 412.

Figure 5:
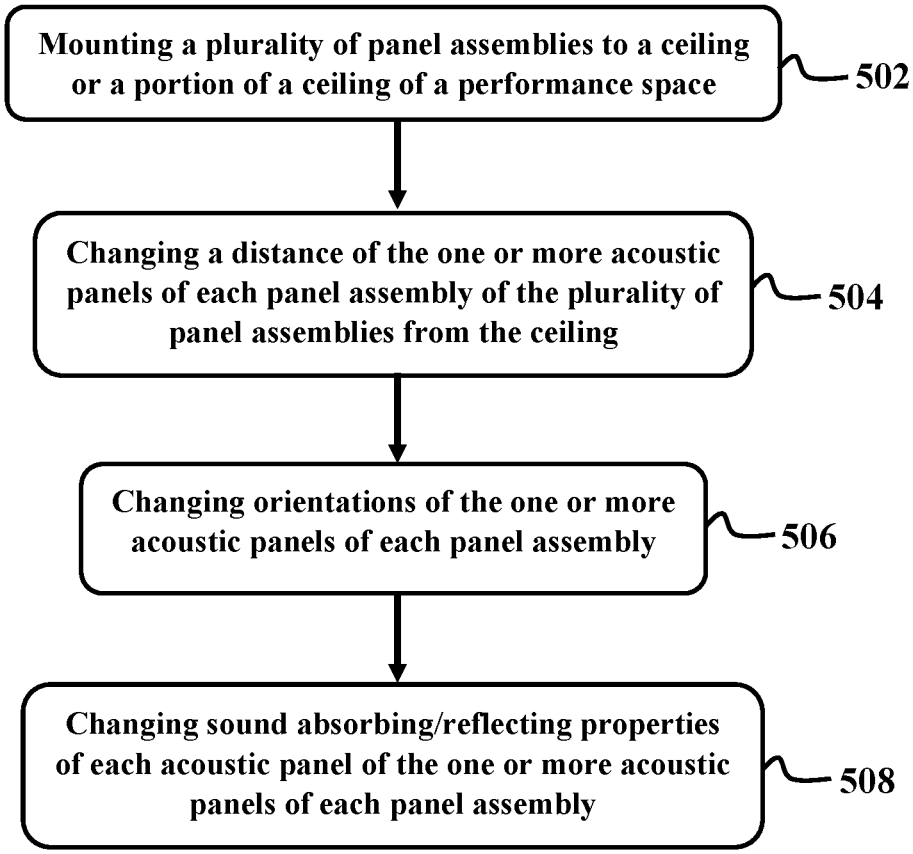
FIG. 5 illustrates a method for dynamically changing acoustics of a performance space in response to changes in acoustical demands within the performance space, consistent with one or more exemplary embodiments of the present disclosure.

FIG. 5 illustrates a method 500 for dynamically changing acoustics of a performance space in response to differences in acoustical demands within the performance space, consistent with one or more exemplary embodiments of the present disclosure. In an exemplary embodiment, method 500 may be implemented utilizing an apparatus similar to apparatus 10.

In an exemplary embodiment, method 500 may include a step 502 of mounting a plurality of panel assemblies to a ceiling or a portion of a ceiling of a performance space, a step 504 of changing a distance of the one or more acoustic panels of each panel assembly of the plurality of panel assemblies from the ceiling, a step 506 of changing orientations of the one or more acoustic panels of each panel assembly, and a step 508 of changing sound absorbing/reflecting properties of each acoustic panel of the one or more acoustic panels of each panel assembly.

In an exemplary embodiment, step 502 of mounting a plurality of panel assemblies to a ceiling or a portion of a ceiling of a performance space may include mounting one or more panel assemblies to the ceiling or a portion of the ceiling, where each panel assembly may include one or more acoustic panels. For example, one or more panel assemblies similar to panel assembly 200 may be mounted to ceiling 12 or a portion of ceiling 12.

In an exemplary embodiment, step 504 of changing a distance of the one or more acoustic panels of each panel assembly of the plurality of panel assemblies from the ceiling may involve coupling the one or more acoustic panels of each panel assembly of the plurality of panel assemblies with a first actuating mechanism. For example, one or more acoustic panels 202*a*, 202*b*, 202*c*, 202*d* of panel assembly 200 may be coupled with first linear actuating mechanism 2040. In an exemplary embodiment, step 504 of changing a distance of the one or more acoustic panels of each panel assembly of the plurality of panel assemblies from the ceiling may further include actuating a linear vertical movement of the one or more acoustic panels of each panel assembly of the plurality of panel assemblies along a first axis perpendicular to the ceiling utilizing the first actuating mechanism. For example, a linear movement of one or more acoustic panels 202*a*, 202*b*, 202*c*, 202*d* of panel assembly 200 may be actuated by first linear actuating mechanism 2040 along axis 206*a* which may be perpendicular to the ceiling or in other words may be parallel with a surface normal of the ceiling.

In an exemplary embodiment, step 506 of changing orientations of the one or more acoustic panels of each panel assembly may include coupling each acoustic panel of the one or more acoustic panels with a respective second actuating mechanism. For example, panel 202*a* of panel assembly 200 may be coupled with second actuating mechanism 2042. First edge 2021 of panel 202*a* may be attached to elongated bar 20420 of second actuating mechanism 2042 utilizing revolute joint 20429. In an exemplary embodiment, step 506 of changing orientations of the one or more acoustic panels of each panel assembly may further include actuating a rotational movement of each acoustic panel of the one or more acoustic panels about a second axis perpendicular to the first axis utilizing the respective second actuating mechanism. For example, second actuator 20424 of second actuating mechanism 2042 may urge elongated bar 20420 to pivot about revolute joint 20422 around axis 206*b*, which in turn may lead to a rotational movement of acoustic panel 202*a* about axis 206*b*.

In an exemplary embodiment, step 506 of changing orientations of the one or more acoustic panels of each panel assembly may further include coupling each acoustic panel of the one or more acoustic panels with a respective third actuating mechanism. For example, panel 202*a* of panel assembly 200 may be coupled with third actuating mechanism 2044 at center point 20446. In an exemplary embodiment, step 506 of changing orientations of the one or more acoustic panels of each panel assembly may further include actuating a rotational movement of each acoustic panel of the one or more acoustic panels about a third axis perpendicular to the second axis utilizing the respective third actuating mechanism. For example, third actuating mechanism 2044 may actuate a rotational movement of acoustic panel 202*a* about revolute joint 20422 around axis 206*c*.

In an exemplary embodiment, step 508 may include changing sound absorbing/reflecting properties of an acoustic panel In an exemplary embodiment, an exemplary acoustic panel may include a first perforated reflective surface, a second perforated reflective surface placed immediately above the first perforated reflective surface and slidably movable relative to the first perforated reflective surface, and a sound absorbing layer positioned immediately above the second perforated surface. In an exemplary embodiment, changing sound absorbing/reflecting properties of each acoustic panel of the one or more acoustic panels of each panel assembly may include sliding the second perforated reflective surface over and relative to the first perforated reflective surface. For example, sound absorbing/reflecting properties of acoustic panel 400 may be changed by sliding perforated reflective layers 408*a*, 408*b* over and relative to first perforated reflective layer 406. In other words, sliding perforated reflective layers 408*a*, 408*b* over and relative to first perforated reflective layer 406 may refer to linearly moving perforated reflective layers 408*a*, 408*b* over first perforated reflective layer 406 in a direction perpendicular to a surface normal of first perforated reflective layer 406.

In an exemplary embodiment, sliding the second perforated reflective surface over and relative to the first perforated reflective surface may include coupling a fourth actuating mechanism with the second perforated reflective surface. For example, linear actuator 412 may be coupled with perforated reflective layers 408*a*, 408*b*. In an exemplary embodiment, sliding the second perforated reflective surface over and relative to the first perforated reflective surface may further include actuating a linear movement of the second perforated reflective surface parallel to a tangential plane to the first perforated reflective surface utilizing the fourth actuating mechanism. For example, linear actuator 412 may actuate a linear movement of perforated reflective layers 408*a*, 408*b* over and relative to first perforated reflective surface 406 along translational axis 414.

A change in acoustic demands within a performance space may arise from a change in performance type. For example, a concert, a play, or a speech by a presenter may require different acoustics within a performance space. A change in acoustic demands within a performance space may further arise from a change in configuration of performance stage. For example, a concert or a play may be performed on a raised stage at either ends of a performance space or they may be performed on a raised stage installed in the middle of a performance space. A change in acoustic demands within a performance space may further arise from a change in seating arrangement of audience members. In exemplary embodiments, method 100, which may be implemented by an apparatus similar to apparatus 10, may allow for changing acoustics of a performance hall by changing a shape of a ceiling of a performance hall and a volume of a performance hall in response to changes in acoustic demands within the performance space.

Figure 6:
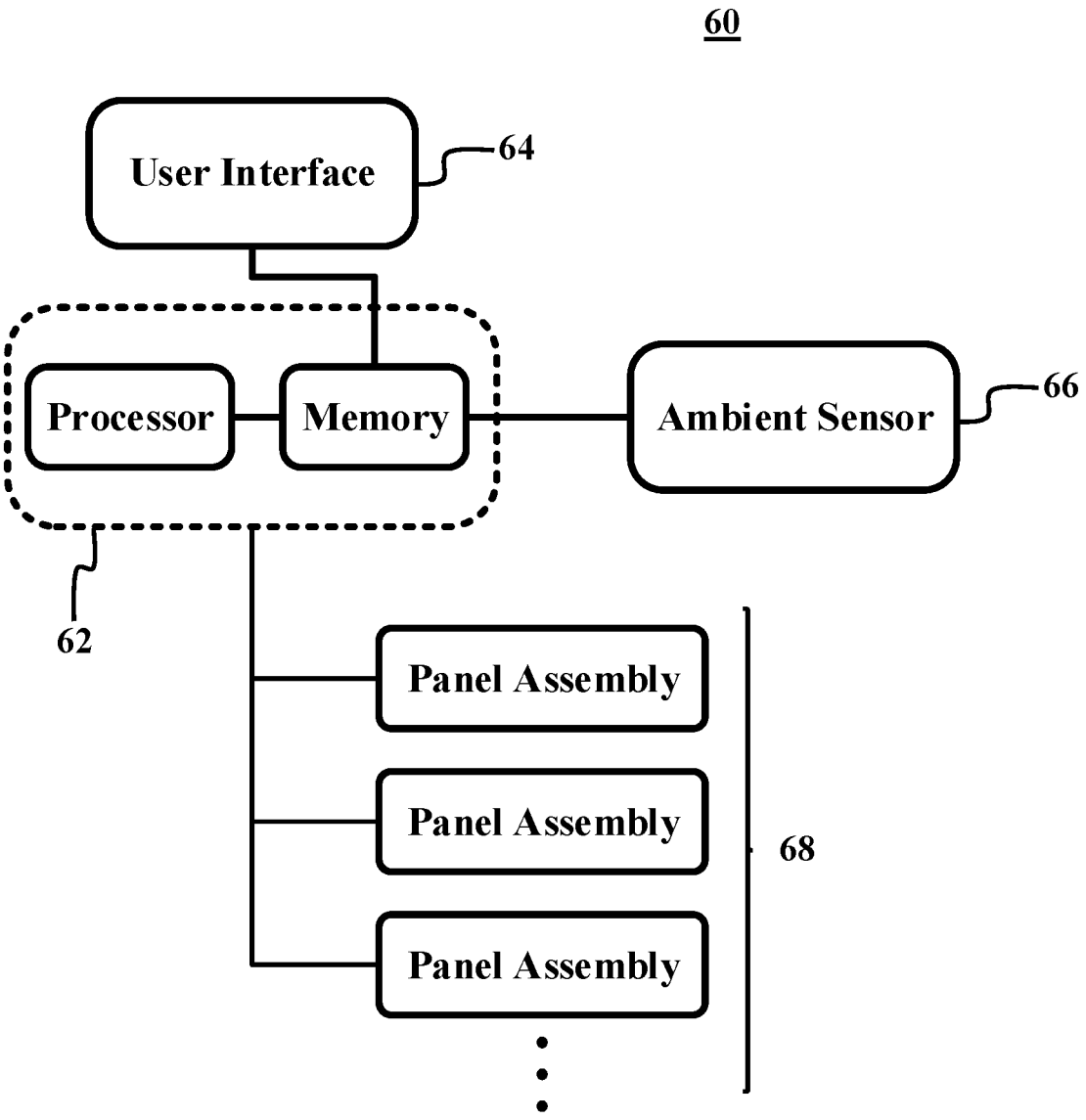
FIG. 6 illustrates a block diagram of a system for dynamically changing acoustics of a performance space in response to changes in acoustical demands within the performance space, consistent with one or more exemplary embodiments of the present disclosure.

FIG. 6 illustrates a block diagram of a system 600 for dynamically changing acoustics of a performance space in response to differences in acoustical demands within the performance space, consistent with one or more exemplary embodiments of the present disclosure. In an exemplary embodiment, system 600 may be utilized for implementing method 500.

In an exemplary embodiment, system 60 may include a control unit 62 that may be functionally coupled to a user-interface unit 64, an ambient sensor unit 66, and panel assemblies 68 that may be mounted to a ceiling or a portion of the ceiling of a performance space. In an exemplary embodiment, each of panel assemblies 68 may be similar to panel assembly 200. In an exemplary embodiment, control unit 62 may be in data communication with user-interface unit 64, ambient sensor unit 66, and panel assemblies 68 through wired links, wireless links, or a combination of wired and wireless links.

In an exemplary embodiment, user-interface unit 64 may include a graphical user interface unit (GUI) that may be configured to receive data input from a user. In an exemplary embodiment, data input from the user may include a desired configuration of panel assemblies 68 that may be selected by the user from a set of predefined configurations of panel assemblies 68 presented to the user by user-interface unit 64. In an exemplary embodiment, data input from the user may further include specific angular orientation and position of each acoustic panel of each panel assembly of panel assemblies 68.

In an exemplary embodiment, each predefined configuration of the set of predefined configurations of panel assemblies 68 may include predefined orientations and position for each acoustic panel of one or more acoustic panels of each panel assembly that may be predefined based on acoustic demands within the performance space. In an exemplary embodiment, predefined configurations of panel assemblies 68 may be predetermined or predefined based at least in part on types of performance, configurations of performance stage and seating arrangements within the performance space. For example, predefined configurations of panel assemblies 68, including predefined orientations and positions, as well as sound reflecting/absorbing properties of each acoustic panel, may be predetermined or predefined to allow for panel assemblies 68 to reflect sounds of performance towards audience in a manner that every audience, regardless of where they may be seated within performance space, may be immersed by the sounds of performance. In another example, predefined configurations of panel assemblies 68, including predefined orientations and positions, as well as sound reflecting/absorbing properties of each acoustic panel, may be predetermined or predefined to allow for panel assemblies 68 to reduce reverberations within performance space. In an exemplary embodiment, control unit 62 may be a programmable logic controller such as a personal computer that may include a memory 622 and a processor 624. Memory 622 may include executable instructions that, when executed, cause processor 1064 to perform operations that in an exemplary embodiment may include processing received data from user-interface unit 64 and urging panel assemblies 68 to assume either a predefined configuration based on the user's choice between a set of predefined configurations for panel assemblies 68 or assume a specific configuration based on specific angular orientation and position of each acoustic panel of each panel assembly input by the user.

In an exemplary embodiment, ambient sensor unit 66 may be configured to sense at least one of acoustic pressure changes in the performance space and occupancy of individuals within the performance space. To this end, ambient sensor unit 66 may include at least one acoustic sensor that may be configured to collect samples of acoustic pressure changes within the performance space, and at least one image capturing device that may be configured to capture images of the performance space. In an exemplary embodiment, memory 622 may further include executable instructions that, when executed, cause processor 1064 to process captured images from image capturing devices to determine the occupancy of individuals within the performance space including number of individuals, seating arrangement of individuals, and movement of individuals within the performance space.

In an exemplary embodiment, memory 622 may further include executable instructions that, when executed, cause processor 1064 to determine a configuration for panel assemblies 68 based at least in part on the determined occupancy of individuals within the performance space, as well as acoustic pressure changes within the performance space at every instance during the performance. Processor 1064 may further urge panel assemblies 68 to assume the determined configuration at every instance during the performance. As used herein, urging panel assemblies 68 to assume the determined configuration may refer to commanding any one or more actuation mechanisms of panel assemblies 68 to actuate the one or more acoustic panels of each of panel assemblies 68 to arrive at a determined configuration. For example, based on the data received from the one or more sound sensors of ambient sensor unit 66, processor 1064 may determine that the performance space has too much reverberation and may accordingly adjust the configuration of panel assemblies 68 to reduce the reverberation within the performance space. In another example, based on the data received from the image capturing devices of ambient sensor unit 66, processor 1064 may determine that a crowd of individuals have gathered in one portion of the performance space and may accordingly adjust the configuration of panel assemblies 68 to achieve a desired acoustic effect in that particular portion of the performance space.

In exemplary embodiments, such configuration of system 600 may enable a user to select a first set of commands to actuate panel assemblies 68 to a first spatial configuration or a second set of commands to actuate panel assemblies 68 to a second spatial configuration that may be distinct from the first spatial configuration. Alternately, control unit 62 may be capable of changing the spatial configuration of panel assemblies 68 based on one or more determinations made based on ambient properties measured by ambient sensor unit 66.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for changing acoustics of a performance space, the method comprising:

mounting a plurality of panel assemblies to a ceiling or a portion of the ceiling of the performance space, each panel assembly of the plurality of panel assemblies comprising one or more acoustic panels, each acoustic panel of the plurality of one or more acoustic panels comprising:

a first perforated reflective surface;

a second perforated reflective surface placed immediately above the first perforated reflective surface and slidably movable relative to the first perforated reflective surface; and a sound absorbing layer positioned immediately above the second perforated surface;

coupling each acoustic panel of the one or more acoustic panels with a respective second actuating mechanism;

coupling each acoustic panel of the one or more acoustic panels with a respective second actuating mechanism;

coupling each acoustic panel of the one or more acoustic panels with a respective third actuating mechanism;

mounting at least one image capturing device on each panel assembly of the plurality of panel assemblies;

capturing images of the performance space by utilizing the at least one image capturing device;

determining at least one of occupancy and movement of individuals within the performance space based at least in part on the captured images of the performance space;

changing at least one of respective distances of each of the one or more acoustic panels from the ceiling, orientations of the one or more acoustic panels of each panel assembly, and sound absorbing/reflecting properties of each acoustic panel of the one or more acoustic panels of each panel assembly based at least in part on the determined occupancy and movement of individuals within the performance space, wherein changing at least one of respective distances of each of the one or more acoustic panels from the ceiling comprises actuating a linear vertical movement of the one or more acoustic panels of each panel assembly of the plurality of panel assemblies along a first axis perpendicular to the ceiling utilizing the first actuating mechanism;

wherein changing the orientations of the one or more acoustic panels of each panel assembly comprises at least one of:

actuating a rotational movement of each acoustic panel of the one or more acoustic panels about a second axis perpendicular to the first axis utilizing the respective second actuating mechanism; and actuating a rotational movement of each acoustic panel of the one or more acoustic panels about a third axis perpendicular to the second axis utilizing the respective third actuating mechanism, and wherein changing the sound absorbing/reflecting properties of each acoustic panel of the one or more acoustic panels of each panel assembly comprises:

actuating a linear vertical movement of the one or more acoustic panels of each panel assembly of the plurality of panel assemblies along a first axis perpendicular to the ceiling utilizing the first actuating mechanism;

actuating a rotational movement of each acoustic panel of the one or more acoustic panels about a second axis perpendicular to the first axis utilizing the respective second actuating mechanism; and actuating a rotational movement of each acoustic panel of the one or more acoustic panels about a third axis perpendicular to the second axis utilizing the respective third actuating mechanism, and wherein changing sound absorbing/reflecting properties of each acoustic panel of the one or more acoustic panels of each panel assembly comprises sliding the second perforated reflective surface over and relative to the first perforated reflective surface.

2. A method for changing acoustics of a performance space, the method comprising:

mounting a plurality of panel assemblies to a ceiling or a portion of the ceiling of the performance space, each panel assembly of the plurality of panel assemblies comprising one or more acoustic panels;

coupling each acoustic panel of the one or more acoustic panels with a respective first actuating mechanism;

coupling each acoustic panel of the one or more acoustic panels with a respective second actuating mechanism;

mounting at least one image capturing device on each panel assembly of the plurality of panel assemblies;

capturing images of the performance space by utilizing the at least one image capturing device;

determining at least one of occupancy and movement of individuals within the performance space based at least in part on the captured images of the performance space;

changing respective distances of each of the one or more acoustic panels from the ceiling based at least in part on the determined occupancy and movement of individuals within the performance space, changing respective distances of each of the one or more acoustic panels from the ceiling comprising actuating a linear vertical movement of the one or more acoustic panels of each panel assembly of the plurality of panel assemblies along a first axis perpendicular to the ceiling utilizing the first actuating mechanism; and changing orientations of the one or more acoustic panels of each panel assembly based at least in part on the determined occupancy and movement of individuals within the performance space, changing orientations of the one or more acoustic panels of each panel assembly comprising actuating a rotational movement of each acoustic panel of the one or more acoustic panels about a second axis perpendicular to the first axis utilizing the respective second actuating mechanism.

3. The method according to claim 2, further comprising:

coupling each acoustic panel of the one or more acoustic panels with a respective third actuating mechanism, wherein changing orientations of the one or more acoustic panels of each panel assembly further comprises actuating a rotational movement of each acoustic panel of the one or more acoustic panels about a third axis perpendicular to the second axis utilizing the respective third actuating mechanism.

4. The method according to claim 2, further comprising changing sound absorbing/reflecting properties of each acoustic panel of the one or more acoustic panels of each panel assembly based at least in part on the determined occupancy and movement of individuals within the performance space, each acoustic panel comprising:

a first perforated reflective surface;

a second perforated reflective surface placed immediately above the first perforated reflective surface and slidably movable relative to the first perforated reflective surface; and a sound absorbing layer positioned immediately above the second perforated surface, wherein changing sound absorbing/reflecting properties of each acoustic panel of the one or more acoustic panels of each panel assembly comprises sliding the second perforated reflective surface over and relative to the first perforated reflective surface.

5. The method according to claim 4, further comprising:

coupling a fourth actuating mechanism with the second perforated reflective surface, wherein sliding the second perforated reflective surface over and relative to the first perforated reflective surface comprises actuating a linear movement of the second perforated reflective surface parallel to a tangential plane to the first perforated reflective surface utilizing the fourth actuating mechanism.

6. The method according to claim 5, wherein actuating the linear movement of the second perforated reflective surface parallel to the tangential plane to the first perforated reflective surface comprises linearly moving the second perforated reflective surface parallel to the tangential plane to the first perforated reflective surface from a first position to a second position, wherein, perforations of the first perforated reflective surface in alignment with corresponding perforations of the second perforated reflective surface in the first position exposing a portion of a surface of the sound absorbing layer to the performance space through the aligned perforations of the first perforated reflective surface and the second perforated reflective surface, and wherein, the perforations of the first perforated reflective surface out of alignment with the corresponding perforations of the second perforated reflective surface in the second position.

7. The method according to claim 3, further comprising determining a first desired orientation of each acoustic panel of the one or more acoustic panels with respect to the second axis and a second desired orientation of each acoustic panel of the one or more acoustic panels with respect to the third axis based at least in part on one of acoustic pressure changes in the performance space and occupancy of individuals in the performance space, wherein, actuating the rotational movement of each acoustic panel of the one or more acoustic panels about the second axis comprises changing an orientation of each acoustic panel of the one or more acoustic panels about the second axis to the first desired orientation, and wherein, actuating the rotational movement of each acoustic panel of the one or more acoustic panels about the third axis comprises changing the orientation of each acoustic panel of the one or more acoustic panels about the third axis to the second desired orientation.

8. The method according to claim 2, further comprising determining a desired distance of the one or more acoustic panels of each panel assembly of the plurality of panel assemblies from the ceiling based at least in part on one of acoustic pressure changes in the performance space and occupancy of individuals in the performance space, wherein, actuating the linear vertical movement of the one or more acoustic panels of each panel assembly of the plurality of panel assemblies along the first axis comprises vertically moving the one or more acoustic panels of each panel assembly of the plurality of panel assemblies to the desired distance.

9. The method according to claim 2, wherein mounting a plurality of panel assemblies to a ceiling or a portion of the ceiling of the performance space comprises mounting each respective first actuating mechanism of each panel assembly of the plurality of panel assemblies to the ceiling or a portion of the ceiling of the performance space, each respective first actuating mechanism comprises:

a telescopic column mounted to the ceiling from an upper end of the telescopic column and attached to the one or more acoustic panels from an opposing lower end of the telescopic column; and a first linear actuator coupled with the telescopic column, and wherein, actuating the linear vertical movement of the one or more acoustic panels of each panel assembly of the plurality of panel assemblies along the first axis comprises vertically extending or retracting the telescopic column utilizing the first linear actuator along the first axis.

10. The method according to claim 9, further comprising:

coupling each acoustic panel of the one or more acoustic panels with a respective second actuating mechanism, the respective second actuating mechanism comprising:

an elongated bar coupled from a first end of the elongated bar with the opposing lower end of the telescopic column utilizing a revolute joint; and a second linear actuator mounted to the opposing lower end of the telescopic column at a first free-to-pivot mounting point above the revolute joint, the second linear actuator coupled to a second end of the elongated bar at a second free-to-pivot mounting point, the second end of the elongated bar away from the revolute joint, wherein coupling each acoustic panel with the respective second actuating mechanism comprises attaching each acoustic panel from a side of each acoustic panel to the elongated bar; and actuating a rotational movement of each acoustic panel of the one or more acoustic panels about a second axis perpendicular to the first axis, actuating the rotational movement of each acoustic panel comprising actuating a rotational movement of the elongated bar about the revolute joint by extending or retracting the second linear actuator.

11. The method according to claim 10, further comprising:

coupling each acoustic panel of the one or more acoustic panels with a respective third actuating mechanism, the third actuating mechanism comprising a third linear actuator mounted on the opposing second end of the elongated bar at a third free-to-pivot mounting point above the second free-to-pivot mounting point, the third linear actuator coupled with each acoustic panel at a fourth free-to-pivot mounting point located in a center of each acoustic panel; and actuating a rotational movement of each acoustic panel of the one or more acoustic panels about a third axis perpendicular to the second axis by extending or retracting the third linear actuator.

12. A system for changing acoustics of a performance space, the system comprising:

a plurality of panel assemblies mounted to a ceiling or a portion of the ceiling of a performance space, each panel assembly of the plurality of panel assemblies comprising:

one or more acoustic panels;

a first actuating mechanism coupled to the one or more acoustic panels, the first actuating mechanism configured to actuate a vertical linear movement of the one or more panel assemblies relative to the ceiling along a first axis;

a second actuating mechanism coupled to each acoustic panel of the one or more acoustic panels, the second actuating mechanism configured to actuate a rotational movement of each acoustic panel about a second axis perpendicular to the first axis;

a third actuating mechanism coupled to each acoustic panel of the one or more acoustic panels, the third actuating mechanism configured to actuate a rotational movement of each acoustic panel about a third axis perpendicular to the second axis;

a sensor unit in data communication with the control unit, the sensor unit comprising:

at least one acoustic sensor configured to collect samples of acoustic pressure changes within the performance space; and at least one image capturing device configured to capture images of the performance space; and a control unit coupled to the plurality of panel assemblies and configured to control one of the first actuating mechanism, the second actuating mechanism, and the third actuating mechanism, the control unit comprises:

a processor; and a memory configured to store executable instructions to cause the processor to:

receive the collected samples of acoustic pressure changes within the performance space from the at least one acoustic sensor;

receive the images of the performance space from the at least one image capturing device;

determine at least one of occupancy and movement of individuals within the performance space based at least in part on the received images of the performance space; and determine a spatial configuration for the panel assemblies based at least in part on the collected samples of acoustic pressure changes within the performance space and the occupancy of individuals within the performance space, and the movement of individuals within the performance space.

13. The system according to claim 12, wherein each acoustic panel of the one or more acoustic panels comprises:

a first perforated reflective surface;

a second perforated reflective surface placed immediately above the first perforated reflective surface and slidably movable relative to the first perforated reflective surface; and a sound absorbing layer positioned immediately above the second perforated surface.

14. The system according to claim 13, further comprising a fourth actuating mechanism coupled to the second perforated reflective surface of each acoustic panel of the one or more acoustic panels, the fourth actuating mechanism configured to actuate a linear movement of the second perforated reflective surface relative to the first perforated reflective surface from a first position to a second position.

15. The system according to claim 14, wherein:

perforations of the first perforated reflective surface in alignment with corresponding perforations of the second perforated reflective surface in the first position exposing a portion of a surface of the sound absorbing layer to the performance space through the aligned perforations of the first perforated reflective surface and the second perforated reflective surface, and wherein, the perforations of the first perforated reflective surface out of alignment with the corresponding perforations of the second perforated reflective surface in the second position.

16. The system according to claim 12, further comprising a user-interface unit connected in data communication with the control unit, the user-interface unit configured to receive a data input from a user, the data input comprising a desired spatial configuration of the plurality of panel assemblies selected by the user from a set of predefined spatial configurations.

17. The system according to claim 12, wherein the first actuating mechanism comprises:

a telescopic column mounted to the ceiling from an upper end of the telescopic column and attached to the one or more acoustic panels from an opposing lower end of the telescopic column; and a first linear actuator coupled with the telescopic column configured to vertically extend or retract the telescopic column along the first axis.

18. The system according to claim 17, wherein:

the second actuating mechanism comprising:

an elongated bar coupled from a first end of the elongated bar with the opposing lower end of the telescopic column utilizing a revolute joint; and a second linear actuator mounted to the opposing lower end of the telescopic column at a first free-to-pivot mounting point above the revolute joint, the second linear actuator coupled to a second end of the elongated bar at a second free-to-pivot mounting point, the second end of the elongated bar away from the revolute joint, and wherein the third actuating mechanism comprising a third linear actuator mounted on the opposing second end of the elongated bar at a third free-to-pivot mounting point above the second free-to-pivot mounting point, the third linear actuator coupled with each acoustic panel at a fourth free-to-pivot mounting point located in a center of each acoustic panel.

* * * * *